US006628077B2

(12) United States Patent
Shirozu

(10) Patent No.: US 6,628,077 B2
(45) Date of Patent: Sep. 30, 2003

(54) ALTERNATING CURRENT DRIVEN TYPE PLASMA DISPLAY

(75) Inventor: Shinichiro Shirozu, Tokyo (JP)

(73) Assignee: Sony Corporation (JP)

( * ) Notice: Subject to any disclaimer, the term of this patent is extended or adjusted under 35 U.S.C. 154(b) by 19 days.

(21) Appl. No.: 09/983,590

(22) Filed: Oct. 25, 2001

(65) Prior Publication Data

US 2002/0050792 A1 May 2, 2002

(30) Foreign Application Priority Data

Oct. 27, 2000 (JP) ..... P2000-328725

(51) Int. Cl.[7] ..... H01J 17/49
(52) U.S. Cl. ..... 313/587; 313/582; 313/586
(58) Field of Search ..... 313/582, 587, 313/484–486, 491, 590; 345/41, 55, 60

(56) References Cited

U.S. PATENT DOCUMENTS

| | | | | | |
|---|---|---|---|---|---|
| 5,640,068 | A | * | 6/1997 | Amemiya | 313/582 |
| 5,962,974 | A | * | 10/1999 | Komaki et al. | 313/582 |
| 6,008,580 | A | * | 12/1999 | Nakamura et al. | 313/568 |
| 6,376,986 | B1 | * | 4/2002 | Takagi et al. | 313/582 |
| 6,411,033 | B1 | * | 6/2002 | Mori et al. | 313/582 |
| 2001/0015621 | A1 | * | 8/2001 | Oniki | 313/582 |
| 2002/0021090 | A1 | * | 2/2002 | Sano et al. | 313/587 |
| 2002/0130618 | A1 | * | 9/2002 | Hasegawa et al. | 313/584 |
| 2002/0135303 | A1 | * | 9/2002 | Hashimoto | 313/582 |

* cited by examiner

*Primary Examiner*—Nimeshkumar D. Patel
*Assistant Examiner*—German Colón
(74) *Attorney, Agent, or Firm*—Rader, Fishman & Grauer PLLC; Ronald P. Kananen, Esq.

(57) ABSTRACT

An alternating current driven type plasma display comprising a first panel having electrode groups formed on a first substrate and a dielectric layer formed on the first substrate and on the electrode groups, and a second panel, the first and second panels being bonded to each other in their circumferential portions. Each electrode group comprises;

(A) a first sustain electrode having two sides opposed to each other and extending in the form of a stripe, (B) a second sustain electrode having two sides opposed to each other and extending in the form of a stripe, (C) a first bus electrode that is in contact with a nearly straight one side of the first sustain electrode, and (D) a second bus electrode that is in contact with a nearly straight one side of the second sustain electrode and is extending in parallel with the first bus electrode.

The other side of the first sustain electrode is in the form of a stripe faces the other side of the second sustain electrode in the form of a stripe.

The distance between the other side of the first sustain electrode in the form of a stripe and the other side of the second sustain electrode in the form of a stripe is greater in a region where they are together close to the bus electrode than in other region.

2 Claims, 13 Drawing Sheets

ALTERNATING CURRENT DRIVEN TYPE PLASMA DISPLAY

BACKGROUND OF THE INVENTION AND RELATED ART STATEMENT

The present invention relates to an alternating current driven type plasma display.

Flat type (flat panel type) displays are studied in various ways as image displays that will replace cathode ray tubes (CRTS) constituting a mainstream at present. As such flat type displays, for example, there are a liquid crystal display (LCD), an electroluminescence display (ELD) and a plasma display (PDP). Of these, a plasma display has advantages that it permits a larger screen and a wider viewing angle relatively easily, that it has excellent durability against environmental factors such as temperature, magnetism and vibrations and that it has a long lifetime. It is expected that a plasma display can be applied not only to a television set of a hanging-up-on-the-wall fashion, but also to a large-scale public information terminal unit.

In the plasma display, a voltage is applied to discharge cells formed by charging discharge spaces with discharge gas consisting of a rare gas, and a phosphor layer in each discharge cell is excited with vacuum ultraviolet ray generated by glow discharge in the discharge gas to give light emission. That is, each discharge cell is driven according to a principle similar to that of a fluorescent lamp, and generally, the discharge cells are put together on the order of hundreds of thousands to constitute a display screen. The plasma display is largely classified into a direct current driven type (DC type) and an alternating current driven type (AC type) according to methods of applying a voltage to the discharge cells, and each type has advantages and disadvantages. The AC type plasma display is suitable for attaining a higher fineness, since separation walls which work to separate the discharge cells individually within a display screen can be formed, for example, in the form of stripes. Further, it has an advantage that electrodes are less worn out and have a long lifetime since the surfaces of the electrodes for discharge are covered with a dielectric layer.

FIG. 11 shows a partial schematic exploded perspective view of a typical constitution of a conventional AC type plasma display. This AC type plasma display comes under a so-called tri-electrode type, and discharging takes place mainly between a pair of sustain electrodes 512. In the AC type plasma display shown in FIG. 11, a first panel 10 corresponding to a front panel and a second panel 20 corresponding to a rear panel are bonded to each other in their circumferential portions.

The first panel 10 comprises a transparent first substrate 11, a plurality of pairs of sustain electrodes 512 made of a transparent electrically conductive material and formed on the first substrate 11 in the form of stripes, bus electrodes 13 made of a material having a lower electric resistivity than the sustain electrodes 512 and formed on the sustain electrodes 512 for decreasing the impedance of the sustain electrodes 512, a dielectric layer 14 formed on the first substrate 11 and also on the bus electrodes 13 and the sustain electrodes 512, and a protective layer 15 made of MgO and formed on the dielectric layer 14.

The second panel 20 comprises a second substrate 21, a plurality of address electrodes (also called data electrodes) 22 formed on the second substrate 21 in the form of stripes, a dielectric material layer 23 formed on the second substrate 21 and also on the address electrodes 22, insulating separation walls 24 formed in regions on the dielectric material layer 23 between neighboring address electrodes 22 and which extend in parallel with the address electrodes 22, and phosphor layers 25 which are formed on the dielectric material layer 23 and are also formed on the side walls of the separation walls 24. When the AC type plasma display is used for display in colors, each phosphor layer 25 is constituted of a red phosphor layer 25R, a green phosphor layer 25G and a blue phosphor layer 25B, and the phosphor layers 25R, 25G and 25B of these colors are formed in a predetermined order.

FIG. 11 is an exploded perspective view, and in an actual embodiment, top portions of the separation walls 24 on the second panel side are in contact with the protective layer 15 on the first panel side. A region where a pair of the sustain electrodes 512 and the address electrode 22 positioned between two of the separation walls 24 overlap corresponds to a discharge cell. A discharge gas is charged in a discharge space surrounded by mutually neighboring two separation walls 24, the phosphor layer 25 and the protective layer 15. The first panel 10 and the second panel 20 are bonded to each other with a frit glass in their circumferential portions.

The extending direction of projection image of the sustain electrodes 512 and the extending direction of projection image of the address electrodes 22 cross each other at right angles, and a region where a pair of the sustain electrodes 512 and one combination of the phosphor layers 25R, 25G and 25B for emitting light in three primary colors overlap corresponds to one pixel. Since glow discharge is caused between the sustain electrodes 512 that are forming a pair, the AC type plasma display of the above type is called "surface discharge type". For example, a pulse voltage lower than the discharge start voltage of the discharge cell is applied to the address electrode 22 immediately before the application of a voltage between a pair of the sustain electrodes 512. In this case, a wall charge is accumulated in the discharge cell (selection of a discharge cell for display), and an apparent discharge start voltage decreases. Then, the discharge that has started between a pair of the sustain electrodes 512 can be sustained at a voltage lower than the discharge start voltage. In the discharge cell, the phosphor layer excited by irradiation with vacuum ultraviolet ray generated by glow discharge in the discharge gas emits light in a color characteristic of a phosphor material. Vacuum ultraviolet ray having a wavelength according to a type of the charged discharge gas is generated. Light emission of the phosphor layer 25 on the second panel 20 is viewed, for example, through the first panel 10.

Generally, the discharge gas charged in the discharge space is composed of a mixture prepared by mixing approximately 4% by volume of xenon (Xe) gas with an inert gas such as neon (Ne) gas, helium (He) gas or argon (Ar) gas. The gas mixture has a total pressure of approximately $6\times10^4$ Pa to $7\times10^4$ Pa, and the xenon (Xe) gas has a partial pressure of approximately $3\times10^3$ Pa. The distance between the sustain electrodes 512 forming each pair is approximately 100 $\mu$m.

FIGS. 12A and 12B and FIGS. 13A and 13B show plane forms of a pair of conventional sustain electrodes 512. For clearly showing the electrodes in FIGS. 12A and 12B and FIGS. 13A and 13B, the electrodes are provided with slanting lines. In these Figures, further, showing of the dielectric layer 14 and the protective layer 15 is omitted.

In an example shown in FIG. 12A, a pair of the sustain electrodes 512 have a plane form consisting of two stripes and have two sides (two edges) extending straight and being opposite to each other. Each bus electrode 13 is in contact with one straightly extending side (one edge) of the sustain electrode 512. The other side (other edge) of one sustain electrode 512 forming a pair and the other side (other edge) of the other sustain electrode 512 forming the pair face each other at a constant interval (distance). For accomplishing a higher fineness of an alternating current driven type plasma display, it is required to decrease the discharge cells in size. When the discharge cells are decreased in size, however, the sustain electrodes constituted as shown in FIG. 12A have a problem that a portion of each sustain electrode that serves for discharging comes to have a smaller length.

FIG. 12B shows a plane form of one example of sustain electrodes that are formed for overcoming the above problem. A pair of such sustain electrodes 512A and 512B have a plane form consisting of two stripes, and have two sides (two edges) being opposite to each other. A bus electrode 13A or 13B is provided so as to be in contact with one straightly extending side (one edge) of the sustain electrode 512A or 512B. The other side (other edge) of one sustain electrode 512A forming a pair and the other side (other edge) of the other sustain electrode 512B forming the pair are formed in curved lines. The interval (distance) between the other sides of the sustain electrodes 512A and 512B forming a pair is constant.

In an example shown in FIG. 13A, a pair of sustain electrodes 512A and 512B have projection portions 512*a* and 512*b* having a rectangular plane form each and extending from bus electrodes 13A and 13B. In an example shown in FIG. 13B, a pair of sustain electrodes 512A and 512B have projection portions 512*a* and 512*b* having a T-letter-shaped plane form each and extending from bus electrodes 13A and 13B.

Meanwhile, in an alternating current driven type plasma display having the structure shown in FIG. 12B, as the discharge cells are decreased in size, abnormal discharge such as arc discharge or spark discharge sometimes takes place in a region where the bus electrode 13A and the sustain electrode 512B come close to each other or in a region where the bus electrode 13B and the sustain electrode 512A come close to each other. In an alternating current driven type plasma display having the structure shown in FIG. 13A or 13B, further, abnormal discharge sometimes takes place between a corner portion of the projection portion 512*a* constituting the sustain electrode 512A and a corner portion of the projection portion 512*b* constituting the sustain electrode 512B. When such abnormal discharge takes place, a current that is abnormally large as compared with general glow discharge flows, which results in destruction of an electrode structure, and the alternating current driven type plasma display is caused to decrease in display quality, reliability and lifetime. Otherwise, a portion where the abnormal discharge has taken place is deteriorated in durability for breakdown.

OBJECT AND SUMMARY OF THE INVENTION

It is therefore an object of the present invention to provide an alternating current driven type plasma display that makes it possible to reliably prevent the occurrence of abnormal discharge.

According to a first aspect of the present invention for achieving the above object, there is provided an alternating current driven type plasma display comprising a first panel having electrode groups formed on a first substrate and a dielectric layer formed on the first substrate and on the electrode groups, and a second panel, the first and second panels being bonded to each other in their circumferential portions, wherein each electrode group comprises;

(A) a first sustain electrode having two sides opposed to each other and extending in the form of a stripe, (B) a second sustain electrode having two sides opposed to each other and extending in the form of a stripe, (C) a first bus electrode that is in contact with a nearly straight one side of the first sustain electrode, and (D) a second bus electrode that is in contact with a nearly straight one side of the second sustain electrode and is extending in parallel with the first bus electrode, and further wherein the other side of the first sustain electrode in the form of a stripe and the other side of the second sustain electrode in the form of a stripe face each other, at least part of the other side of the first sustain electrode in the form of a stripe and at least part of the other side of the second sustain electrode in the form of a stripe have the form of a curved line each, and the distance between the other side of the first sustain electrode in the form of a stripe and the other side of the second sustain electrode in the form of a stripe is greater in a region where they are together close to the bus electrode than in other region.

In the plasma display according to the first aspect of the present invention, since the distance between the other side of the first sustain electrode in the form of a stripe and the other side of the second sustain electrode in the form of a stripe is arranged to be greater in a region where they are together close to the bus electrode than in other region, the occurrence of abnormal discharge between the first sustain electrode and the second bus electrode and the occurrence of abnormal discharge between the second sustain electrode and the first bus electrode can be reliably prevented.

According to a second aspect of the present invention for achieving the above object, there is provided an alternating current driven type plasma display comprising a first panel having electrode groups formed on a first substrate and a dielectric layer formed on the first substrate and on the electrode groups, and a second panel, the first and second panels being bonded to each other in their circumferential portions, wherein each electrode group comprises;

(A) a first bus electrode, (B) a second bus electrode extending in parallel with the first bus electrode, (C) a first sustain electrode having a projection portion extending from the first bus electrode toward the second bus electrode, and (D) a second sustain electrode having a projection portion extending from the second bus electrode toward the projection portion of the first sustain electrode, and further wherein the top end portion of the projection portion of the first sustain electrode and the top end portion of the projection portion of the second sustain electrode face each other, and the corner portions of the top end portion of the projection portion of the first sustain electrode and the corner portions of the top end portion of the projection portion of the second sustain electrode are chamfered.

In the alternating current driven type plasma display according to the second aspect of the present invention, the corner portions of the top end portion of the projection portion of the first sustain electrode and the corner portions of the top end portion of the projection portion of the second sustain electrode are chamfered, so that a kind of projections are removed from the top end portions of the projection portions. As a result, the occurrence of abnormal discharge between the projection portion of the first sustain electrode and the projection portion of the second sustain electrode can be reliably prevented.

According to a third aspect of the present invention for achieving the above object, there is provided an alternating current driven type plasma display comprising a first panel having electrode groups formed on a first substrate and a dielectric layer formed on the first substrate and on the electrode groups, and a second panel, the first and second panels being bonded to each other in their circumferential portions, wherein each electrode group comprises;

(A) a first bus electrode, (B) a second bus electrode extending in parallel with the first bus electrode, (C) a first sustain electrode having a projection portion extending from the first bus electrode toward the second bus electrode, and (D) a second sustain electrode having a projection portion extending from the second bus electrode toward the projection portion of the first sustain electrode, and further wherein the top end portion of the projection portion of the first sustain electrode and the top end portion of the projection portion of the second sustain electrode face each other, and the distance between the top end portion of the projection portion of the first sustain electrode and the top end portion of the projection portion of the second sustain electrode is broadened from the center of each top end portion to edge portions of each top end portion.

In the alternating current driven type plasma display according to the third aspect of the present invention, the distance between the top end portion of the projection portion of the first sustain electrode and the top end portion of the projection portion of the second sustain electrode is broadened from the center of each top end portion to the edge portions of each top end portion, so that the occurrence of abnormal discharge between the projection portion of the first sustain electrode and the projection portion of the second sustain electrode can be reliably prevented.

According to a fourth aspect of the present invention for achieving the above object, there is provided an alternating current driven type plasma display comprising a first panel having electrode groups formed on a first substrate and a dielectric layer formed on the first substrate and on the electrode groups, and a second panel, the first and second panels being bonded to each other in their circumferential portions, wherein each electrode group comprises;

(A) a first sustain electrode having two sides opposed to each other and extending in the form of a stripe, (B) a second sustain electrode having two sides opposed to each other and extending in the form of a stripe, (C) a first bus electrode that is in contact with one nearly-straight side of the first sustain electrode, and (D) a second bus electrode that is in contact with one nearly-straight side of the second sustain electrode and extending in parallel with the first bus electrode, and further wherein the other side of the first sustain electrode in the form of a stripe and the other side of the second sustain electrode in the form of a stripe face each other, at least part of the other side of the first sustain electrode in the form of a stripe and at least part of the other side of the second sustain electrode in the form of a stripe have the form of a curved line each, a first discharge-inhibiting layer is formed at least in a portion of the other side of the first sustain electrode in a region where the first sustain electrode is close to the second bus electrode, and a second discharge-inhibiting layer is formed at least in a portion of the other side of the second sustain electrode in a region where the second sustain electrode is close to the first bus electrode.

According to a fifth aspect of the present invention for achieving the above object, there is provided an alternating current driven type plasma display comprising a first panel having electrode groups formed on a first substrate and a dielectric layer formed on the first substrate and on the electrode groups, and a second panel, the first and second panels being bonded to each other in their circumferential portions, wherein each electrode group comprises;

(A) a first bus electrode, (B) a second bus electrode extending in parallel with the first bus electrode, (C) a first sustain electrode having a projection portion extending from the first bus electrode toward the second bus electrode, and (D) a second sustain electrode having a projection portion extending from the second bus electrode toward the projection portion of the first sustain electrode, and further wherein the top end portion of the projection portion of the first sustain electrode and the top end portion of the projection portion of the second sustain electrode face each other, and a discharge-inhibiting layer is formed on each corner portion of the top end portion of the projection portion of the first sustain electrode and on each corner portion of the top end portion of the projection portion of the second sustain electrode.

In the alternating current driven type plasma display according to the fourth or fifth aspect of the present invention, the discharge-inhibiting layer is formed, so that the occurrence of abnormal discharge between the first sustain electrode and the second bus electrode, between the second sustain electrode and the first bus electrode or between the projection portion of the first sustain electrode and the projection portion of the second sustain electrode can be reliably prevented.

In the alternating current driven type plasma display according to the first or fourth aspect of the present invention, the curved line form of at least part of the other side of the first sustain electrode and the curved line form of at least part of the other side of the second sustain electrode may be the form of any curved line or a combination of any curved lines, such as a combination of arcs, a combination of sine curves, a combination of elliptical curves, a combination of parabolas, a combination of hyperbolas, a combination of "dogleg" forms, a combination of "S" letters, a combination of at least two members selected from the group consisting of arcs, sine curves, elliptical curves, parabolas, hyperbolas, "dogleg" forms and "S" letters, a combination of a segment with a combination of arcs, sine curves, elliptical curves, parabolas, hyperbolas or "dogleg" forms. When the segment is further combined, desirably, the segment is arranged to be positioned in parallel with the bus electrode in a position close to the bus electrode. In view of more reliably preventing the occurrence of abnormal discharge, desirably, the curved line has no bent portion.

In the alternating current driven type plasma display according to the third aspect of the present invention, desirably, the form of the top end portion of the projection portion of the sustain electrode is the form of a moderately curved line, such as the form of an arc, a sine curve, an elliptical curve, a parabolic curve, a hyperbolic curve and the like.

In the alternating current driven type plasma display according to the first aspect of the present invention, desirably, the distance between the other side of the first sustain electrode and the other side of the second sustain electrode in a region other than the region where they are close to the bus electrode (the region which is "other region" and a region that contributes to starting of glow discharge) is $1\times10^{-4}$ m or less, preferably less than $5\times10^{-5}$ m, more preferably $4\times10^{-5}$ m or less, still more preferably $2.5\times10^{-5}$ m or less. The minimum value of the distance in the above "other region" can be set to be a distance in which no dielectric breakdown occurs between the first sustain electrode and the second sustain electrode. The distance between the other side of the first sustain electrode and the other side of the second sustain electrode in a region where they are close to the bus electrode can be set to have a value at which no abnormal discharge takes place between the first sustain electrode and the second bus electrode and between the second sustain electrode and the first bus electrode.

In the alternating current driven type plasma display according to the first or fourth aspect of the present invention, the embodiment in which the bus electrode is in contact with the nearly straight side of the sustain electrode includes the following embodiments:

① An embodiment in which the bus electrode in the form of a stripe is formed on the sustain electrode in the vicinity of the nearly straight side of the sustain electrode;

② An embodiment in which the bus electrode in the form of a stripe is formed on the sustain electrode in the vicinity of the nearly straight side of the sustain electrode, and the nearly straight side of the sustain electrode and one side of the bus electrode in the form of a stripe are in agreement; and ③ An embodiment in which the bus electrode in the form of a stripe is formed on the sustain electrode and is extending over the nearly straight side of the sustain electrode to reach on the first substrate.

In the alternating current driven type plasma display according to the fourth aspect of the present invention, it is sufficient that the first discharge-inhibiting layers should be formed at least in a portion of the other side of the first sustain electrode in a region where the first sustain electrode is close to the second bus electrode, and the formation of the first discharge-inhibiting layers includes the following embodiments:

① An embodiment in which the first discharge-inhibiting layer is formed in a portion of the other side of the first sustain electrode in a region where the first sustain electrode is close to the second bus electrode.

② An embodiment in which the first discharge-inhibiting layer is formed in a portion of the other side of the first sustain electrode and a portion of the other side of the second sustain electrode in a region where the first sustain electrode is close to the second bus electrode.

③ An embodiment in which the first discharge-inhibiting layer is formed from a portion of the other side of the first sustain electrode to a portion of the other side of the second sustain electrode in a region where the first sustain electrode is close to the second bus electrode.

In the alternating current driven type plasma display according to the fourth aspect of the present invention, it is sufficient that the second discharge-inhibiting layers should be formed at least in a portion of the other side of the second sustain electrode in a region where the second sustain electrode is close to the first bus electrode, and the formation of the second discharge-inhibiting layers includes the following embodiments.

① An embodiment in which the second discharge-inhibiting layer is formed in a portion of the other side of the second sustain electrode in a region where the second sustain electrode is close to the first bus electrode.

② An embodiment in which the second discharge-inhibiting layer is formed in a portion of the other side of the first sustain electrode and a portion of the other side of the second sustain electrode in a region where the second sustain electrode is close to the first bus electrode.

③ An embodiment in which the second discharge-inhibiting layer is formed from a portion of the other side of the first sustain electrode to a portion of the other side of the second sustain electrode in a region where the second sustain electrode is close to the first bus electrode.

In the alternating current driven type plasma display according to the fourth aspect of the present invention, the distance between the other side of the first sustain electrode and the other side of the second sustain electrode can be set to be $1\times10^{-4}$ m or less, preferably less than $5\times10^{-5}$ m, more preferably $4\times10^{-5}$ m or less, still more preferably $2.5\times10^{-5}$ m or less. Otherwise, the above distance may be set to be similar to the distance in the alternating current driven type plasma display according to the first aspect of the present invention. Further, the minimum value of the distance can be set to be a value at which no dielectric breakdown takes place between the first sustain electrode and the second sustain electrode.

In the alternating current driven type plasma display according to the second or fifth aspect of the present invention, the distance between the top end portion of the projection portion of the first sustain electrode and the top end portion of the projection portion of the second sustain electrode can be set to be a constant distance of $1\times10^{-4}$ m or less, preferably less than $5\times10^{-5}$ m, more preferably $4\times10^{-5}$ m or less, still more preferably $2.5\times10^{-5}$ m or less. Alternatively, in the alternating current driven type plasma display according to the fifth aspect of the present invention, the above distance may be set to be similar to the distance in the alternating current driven type plasma display according to the third aspect of the present invention. Further, the minimum value of the distance can be set to be a value at which no dielectric breakdown takes place between the top end portion of the projection portion of the first sustain electrode and the top end portion of the projection portion of the second sustain electrode.

In the alternating current driven type plasma display according to the third aspect of the present invention, the shortest distance between the top end portion of the projection portion of the first sustain electrode and the top end portion of the projection portion of the second sustain electrode can be set to be $1\times10^{-4}$ m or less, preferably less than $5\times10^{-5}$ m, more preferably $4\times10^{-5}$ m or less, still more preferably $2.5\times10^{-5}$ m or less. The minimum value of the shortest distance between the top end portion of the projection portion of the first sustain electrode and the top end portion of the projection portion of the second sustain electrode can be set to be a value at which no abnormal discharge takes place between the top end portion of the projection portion of the first sustain electrode and the top end portion of the projection portion of the second sustain electrode.

In the alternating current driven type plasma display according to any one of the first to fifth aspects of the present invention (to be abbreviated as "plasma display of the present invention" hereinafter), preferably, the second panel comprises a second substrate, phosphor layers formed above the second substrate and separation walls that extend at a predetermined angle from the extending direction of the electrodes and are formed between neighboring phosphor layers.

The thus-constituted plasma display of the present invention has a structure in which the first panel and the second panel are arranged such that the dielectric layer and the phosphor layers face each other, the extending direction of the bus electrodes and the extending direction of each separation wall make a predetermined angle (for example, 90°), the space surrounded by the dielectric layer, the phosphor layer and a pair of the separation walls is charged with a rare gas, and the phosphor layer emits light by irradiation with vacuum ultraviolet ray generated, in the rare gas, on the basis of AC glow discharge that takes place between a pair of facing sustain electrodes. A region where one set of the first and second sustain electrodes and the first and second bus electrodes and a pair of the separation walls overlap corresponds to one pixel.

In the plasma display of the present invention, the rare gas charged in the space surrounded by the dielectric layer, the phosphor layer and a pair of the separation walls desirably has a pressure of from $1\times10^2$ Pa (0.001 atmospheric pressure) to $5\times10^5$ Pa (5 atmospheric pressures), preferably $1\times10^3$ Pa (0.01 atmospheric pressure) to $4\times10^5$ Pa (4 atmospheric pressures). When the distance between the other side of the first sustain electrode in the form of a stripe and the other side of the second sustain electrode in the form of a stripe is less than $5\times10^{-5}$ m, desirably, the pressure of the rare gas in the space is adjusted to $1.0\times10^2$ Pa (0.001 atmospheric pressure) to $3.0\times10^5$ Pa (3 atmospheric pressures), preferably, to $1.0\times10^3$ Pa (0.01 atmospheric pressure) to $2.0\times10^5$ Pa (2 atmospheric pressures), more preferably, to $1.0\times10^4$ Pa (0.1 atmospheric pressure) to $1.0\times10^5$ Pa (1 atmospheric pressures). In the above pressure range, the phosphor layer emits light when irradiated with vacuum ultraviolet ray generated mainly on the basis of cathode glow in the rare gas. In the above pressure range, the sputtering ratio of various members constituting the plasma display decreases with an increase in the pressure, and as a result, the lifetime of the plasma display device can be increased.

Preferably, the second electrode group constituted of a plurality of second electrodes is formed on the first substrate or the second substrate. In the former case, there can be employed a constitution in which the second electrodes are formed on an insulating layer formed on the dielectric layer and the extending direction of the second electrodes and the extending direction of the bus electrodes make a predetermined angle (for example, 90°). In the latter case, there may be employed a constitution in which the second electrodes are formed on the second substrate, the extending direction of the second electrodes and the extending direction of the bus electrodes make a predetermined angle (for example, 90°), and the phosphor layer is formed above the second electrodes.

It is preferred to employ a constitution in which the electrically conductive material constituting the first and second sustain electrodes and the electrically conductive material constituting the first and second bus electrodes differ from each other. The electrically conductive material for the first and second sustain electrodes differs depending upon whether the plasma display is a transmission type or a reflection type. In the transmission type plasma display, light emission from the phosphor layers is observed through the second panel, so that it is not any problem whether the electrically conductive material constituting the first and second sustain electrodes is transparent or non-transparent. However, the electrically conductive material constituting the second electrodes is desirably transparent when the second electrodes are formed on the second substrate. In the reflection type plasma display, light emission from the phosphor layers is observed trough the first substrate, so that it is not any problem whether the electrically conductive material constituting the second electrodes is transparent or non-transparent when the second electrodes are formed on the second substrate. However, it is desirable that the electrically conductive material constituting the first and second sustain electrodes is transparent.

The above term "transparent or non-transparent" is based on the transmissivity of the electrically conductive material to light at a wavelength of emitted light (in visible light region) inhererent to phosphor materials. That is, when an electrically conductive material constituting the first and second sustain electrodes is transparent to light emitted from the phosphor layers, it can be said that the electrically conductive material is transparent. The non-transparent electrically conductive material includes Ni, Al, Au, Ag, Pd/Ag, Cr, Ta, Cu, Ba, $LaB^6$, $Ca_{0.2}La_{0.8}CrO_3$, etc., and these materials may be used alone or in combination. The transparent electrically conductive material includes ITO (indium-tin oxide) and $SnO_2$.

The method for forming the first and second sustain electrodes can be selected from a vapor deposition method, a sputtering method, a screen printing method, a sand blasting method, a plating method or a lift-off method as required depending upon the electrically conductive material to be used. That is, the first and second sustain electrodes can be formed as first and second sustain electrodes having a predetermined pattern from the beginning by the use of a proper mask or screen, or the first and second sustain electrodes can be formed by forming an electrically conductive material layer on the entire surface and then patterning the electrically conductive material layer.

The first and second bus electrodes can be constituted, typically, of a metal material such as Ag, Al, Ni, Cu or Cr, or a stacked film such as a Cr/Cu/Cr stacked film or a Cr/Al/Cr stacked film. In the reflection type plasma display, the first and second bus electrodes made of the above metal material or the stacked film can be a factor to decrease a transmission quantity of visible light which is emitted from the phosphor layers and passes through the first substrate, so that the brightness of a display screen is decreased. It is therefore preferred to form the bus electrodes so as to be as narrow as possible so long as an electric resistance value necessary for the first and second sustain electrodes can be obtained. The method for forming the first and second bus electrodes can be selected from a vapor deposition method, a sputtering method, a screen printing method, a sand blasting method, a plating method or a lift-off method as required depending upon an electrically conductive material to be used.

In the plasma display of the present invention, since the dielectric layer is provided, the direct contact of ions and electrons to the first and second sustain electrodes can be prevented. As a result, the wearing of the first and second sustain electrodes can be prevented. The dielectric layer not only works to accumulate a wall charge, but also has functions as a resistor to limit an excess discharge current and a memory to sustain a discharge state. The material for the dielectric layer is required to be transparent when the plasma display is a reflection type, since the light emission from the phosphor layers is observed through the first substrate. The material for the dielectric layer includes, for example, a low-melting glass and silicon oxide.

In the plasma display of the present invention, desirably, a protective layer is formed on the dielectric layer. The material for the protective layer includes materials having a high secondary electron emission ratio, specifically, such as magnesium oxide (MgO), magnesium fluoride ($MgF_2$) and calcium fluoride ($CaF_2$). Of these, magnesium oxide is a suitable material having properties such as a high secondary electron emission ratio, a low sputtering ratio, a high light transmissivity at a wavelength of light emitted from the phosphor layers and a low discharge start voltage. The protective layer may be formed of a stacked structure composed of at least two materials selected from the group consisting of the above materials.

Preferably, the discharge-inhibiting layer is made of a material having a low secondary electron emission ratio and a high work function $\Phi$ from the viewpoint that such a material causes little or no electron avalanche, emits little or no electrons and causes little or no plasma discharge. Further, desirably, the material for the discharge-inhibiting layers is a material having easy process-ability and electric insulation properties. Specific examples of the above material include various insulating materials for use in the production of semiconductor devices such as $SiO_2$ and SiN, a glass sintered body, a combination of $SiO_2$ and a glass sintered body, metal oxides such as $Al_2O_3$ and $Cr_2O_3$, and metal nitrides such as boron nitride (BN), tungsten nitride (WN) and aluminum nitride (AlN).

The material for the first substrate and the second substrate includes a high-distortion-point glass, soda glass ($Na_2O.CaO.SiO_2$), borosilicate glass ($Na_2O.B_2O_3.SiO_2$), forsterite ($2MgO.SiO_2$) and lead glass ($Na_2O.PbO.SiO_2$). The material for the first substrate and the material for the second substrate may be the same as, or different from, each other.

The plasma display of the present invention is a so-called surface-discharge type plasma display. When the second electrode is formed on the second substrate, and when the function of the phosphor layer as a dielectric material layer is insufficient, a dielectric material layer may be formed between the second electrode group and the phosphor layer.

The phosphor layer is made of a phosphor material selected from the group consisting of a phosphor material that emits light in red, a phosphor material that emits light in green and a phosphor material that emits light in blue. The phosphor layer is formed on or above the second substrate. When the second electrode is formed on the second substrate, specifically, the phosphor layer made of a phosphor material for emitting light in red (red phosphor layer) is formed on or above the second electrode, the phosphor layer made of a phosphor material for emitting light in green (green phosphor layer) is formed on or above another second electrode, the phosphor layer made of a phosphor material for emitting light in blue (blue phosphor layer) is formed on or above still another second electrode, these phosphor layers for emitting light in three primary colors are combined to form one set, and such sets are arranged in a predetermined order. When the second electrode is formed on the first substrate, a red phosphor layer, a green phosphor layer and a blue phosphor layer are formed on the second substrate, these phosphor layers for emitting light in three primary colors are combined to form one set, and such sets are arranged in a predetermined order. A region where the first and second bus electrodes, the first and second sustain electrodes and one set of the phosphor layers for emitting light in three primary colors overlap corresponds to one pixel. The red phosphor layer, the green phosphor layer and the blue phosphor layer may be formed in the form of stripes or a grille. Further, the phosphor layer may be formed only in a region where the sustain electrode and the second electrode overlap. When the red phosphor layer, the green phosphor layer and the blue phosphor layer are formed in the form of stripes and when the second electrode is formed on the second substrate, one red phosphor layer is formed on or above one second electrode, one green phosphor layer is formed on or above one second electrode, and one blue phosphor layer is formed on or above one second electrode. When the red phosphor layer, the green phosphor layer and the blue phosphor layer are formed in the form of a grille, the red phosphor layer, the green phosphor layer and the blue phosphor layer are formed in a predetermined order on one second electrode.

When the second electrode is formed on the second substrate, the phosphor layer may be formed directly on the second electrode, or may be formed on the second electrode and also on the side walls of the separation walls. Alternatively, the phosphor layer may be formed on the dielectric material layer formed on the second electrode, or may be formed on the dielectric material layer formed on the second electrode and also on the side walls of the separation walls. Further, the phosphor layer may be formed only on the side walls of the separation walls. That "the phosphor layer is formed on or above the second electrode" is a concept including all of the above-discussed embodiments in various forms.

The material for the dielectric material layer can be selected from a low-melting glass or silicon oxide, and it can be formed by a screen printing method, a sputtering method or a vacuum vapor deposition method. In some cases, a protective layer made of magnesium oxide (MgO), magnesium fluoride ($MgF_2$) or calcium fluoride ($CaF_2$) may be formed on the phosphor layer and/or the separation walls.

As phosphor materials for the phosphor layer, phosphor materials that have a high quantum efficiency and cause less saturation to vacuum ultraviolet ray can be selected from known phosphor materials as required. When the plasma display is intended for use as a color display, it is preferred to combine those phosphor materials which have color purities close to three primary colors defined in NTSC, which are well balanced to give white when three primary colors are mixed, which show a small afterglow time period and which can secure that the afterglow time periods of three primary colors are nearly equal. Examples of the phosphor material that emits light in red upon irradiation with vacuum ultraviolet ray include ($Y_2O_3$:Eu), ($YBO_3$:Eu), ($YVO_4$:Eu), ($Y_{0.96}P_{0.60}V_{0.40}O_4$:$Eu_{0.04}$), [(Y,Gd)$BO_3$:Eu], ($GdBO_3$:Eu), ($ScBO_3$:Eu) and ($3.5MgO.0.5MgF_2.GeO_2$:Mn). Examples of the phosphor material that emits light in green upon irradiation with vacuum ultraviolet light include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb) and ($Sr_4Si_3O_8Cl_4$:Eu). Examples of the phosphor material that emits light in blue upon irradiation with vacuum ultraviolet ray include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu) and ($Sr_2P_2O_7$:Sn).

The method for forming the phosphor layers includes a thick film printing method, a method in which phosphor particles are sprayed, a method in which an adhesive substance is pre-applied to a region where the phosphor layers are to be formed and phosphor particles are allowed to adhere, a method in which a photosensitive phosphor paste is provided and a phosphor layer is patterned by exposure and development, and a method in which a phosphor layer is formed on the entire surface and unnecessary portions are removed by a sand blasting method.

The separation walls may have a constitution in which they extend in parallel with the second electrodes in regions between neighboring second electrodes. That is, there may be employed a constitution in which one second electrode extends between a pair of the separation walls. In some cases, the separation walls may have a constitution in which a first separation wall extends in parallel with the bus electrodes in a region between neighboring bus electrodes and a second separation wall extends in parallel with the second electrodes in a region between neighboring second electrodes (that is, in the form of a grille). While the separation walls in the form of a grille are conventionally used in a DC driven type plasma display, they can be applied to the alternating current driven type plasma display of the present invention. The separation walls may have a meander structure.

The material for the separation wall can be selected from known insulating materials. For example, a mixture of a widely used low-melting glass with a metal oxide such as alumina can be used.

The method for forming the separation wall includes a screen printing method, a sand blasting method, a dry filming method and a photosensitive method. The above screen printing method refers to a method in which opening portions are made in those portions of a screen which correspond to portions where the separation walls are to be formed, a separation-wall-forming material on the screen is passed through the opening portions with a squeeze to form a separation-wall-forming material layer on the second substrate or the dielectric material layer (these will be generically referred to as "second substrate or the like" hereinafter), and then the separation-wall-forming material layer is calcined or sintered. The above dry filming method refers to a method in which a photosensitive film is laminated on the second substrate or the like, photosensitive film on regions where the separation walls are to be formed is removed by exposure and development, opening portions formed by the removal are filled with a separation-wall-forming material and the separation-wall-forming material is calcined or sintered. The photosensitive film is combusted and removed by the calcining or sintering and the separation-wall-forming material filled in the opening portions remains to constitute the separation walls. The above photosensitive method refers to a method in which a photosensitive material layer for forming the separation walls is formed on the second substrate or the like, the material layer is patterned by exposure and development and then the patterned material layer is calcined or sintered. The above sand blasting method refers to a method in which a material layer for forming the separation walls is formed on the second substrate or the like, for example, by screen printing or with a roll coater, a doctor blade or a nozzle-ejecting coater and is dried, then, those portions in the material layer where the separation walls are to be formed are covered with a mask layer, and exposed portions of the material layer are removed by a sand blasting method. The separation walls may be formed in black to form a so-called black matrix. In this case, a high contrast of the display screen can be attained. The method of forming the black separation walls includes a method in which a light-absorbing layer such as a photosensitive silver paste layer or a low-reflection chromium layer is formed on the top portion of each separation wall and a method in which the separation walls are formed from a color resist material colored in black.

The rare gas to be charged and sealed in the space is required to satisfy the following requirements.

① The rare gas is chemically stable and permits setting of a high gas pressure from the viewpoint of attaining a longer lifetime of the plasma display device;

② The rare gas has a high radiation intensity of vacuum ultraviolet ray from the viewpoint of attaining a higher brightness of a display screen;

③ Radiated vacuum ultraviolet ray has a long wavelength from the viewpoint of increasing energy conversion efficiency from vacuum ultraviolet ray to visible light; and ④ The discharge start voltage is low from the viewpoint of decreasing power consumption.

As a rare gas, He (wavelength of resonance line=58.4 nm), Ne (ditto=74.4 nm), Ar (ditto=107 nm), Kr (ditto=124 nm) and Xe (ditto=147 nm) can be used alone or as mixed gases. Mixed gases are particularly useful since a decrease in the discharge start voltage based on a Penning effect can be expected. Examples of the above mixed gases include Ne—Ar mixed gases, He—Xe mixed gases and Ne—Xe mixed gases. Of these rare gases, Xe having the longest resonance line wavelength is suitable since it also radiates intense vacuum ultraviolet ray having a wavelength of 172 nm.

BRIEF DESCRIPTION OF THE DRAWINGS

The present invention will be explained on the basis of Examples and with reference to drawings.

DESCRIPTION OF THE PREFERRED EMBODIMENTS

EXAMPLE 1

Figure 1A:
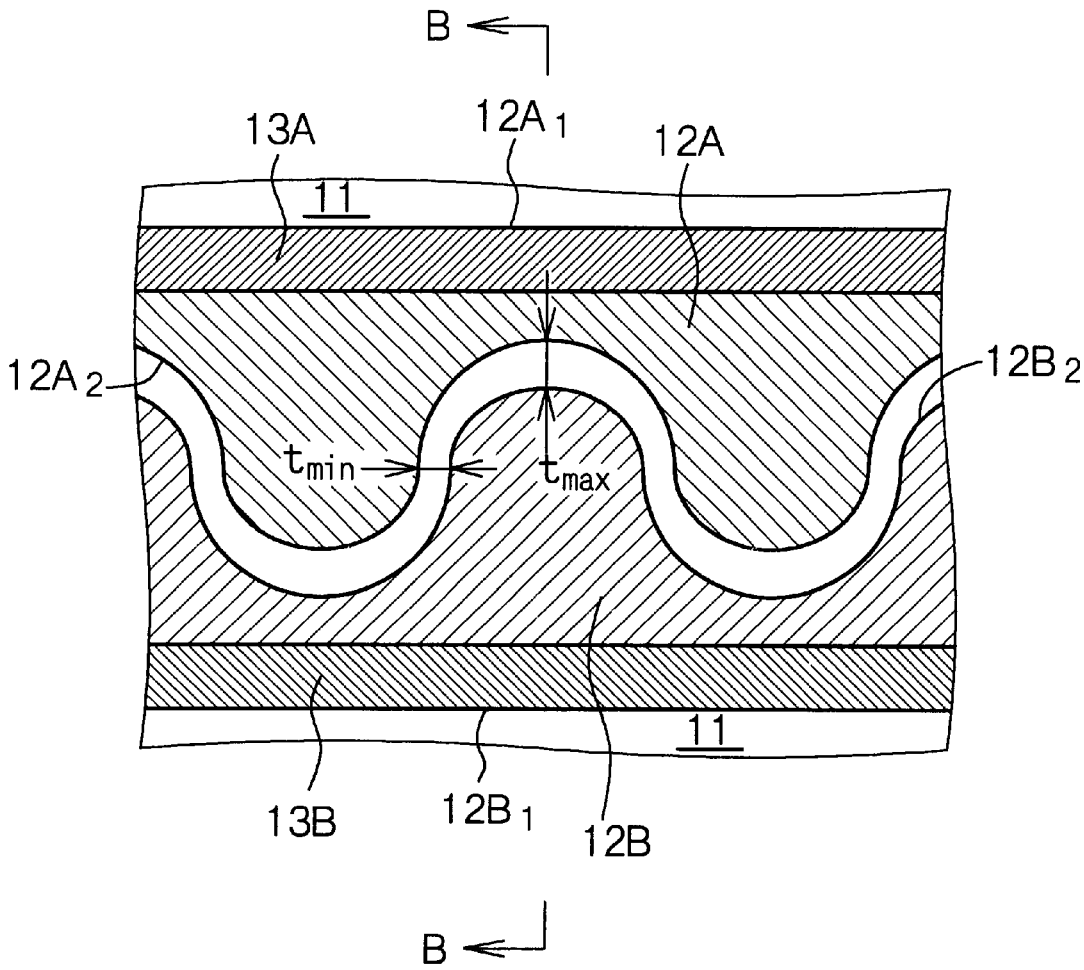
FIG. 1A is a schematic layout of the electrode group in an alternating current driven type plasma display of Example 1.

Example 1 is concerned with a plasma display according to the first aspect of the present invention. As shown in the schematic exploded perspective view of FIG. 2, the plasma display comprises a first panel 10 (corresponding to a front panel) and a second panel 20 (corresponding to a rear panel). The first panel 10 has electrode groups formed on a transparent first substrate 11 made, for example, of glass and a dielectric layer 14 made of a glass paste and formed on the first substrate and also on the electrode groups. These first panel 10 and the second panel 20 are bonded to each other in their circumferential portions. Further, a protective layer 15 made of MgO is formed on the dielectric layer 14.

Figure 1B:
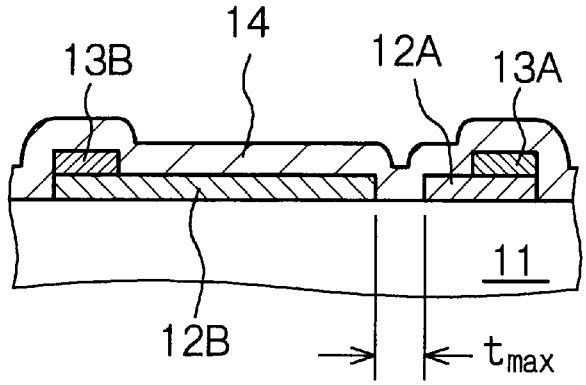
FIG. 1B is a schematic partial cross-sectional view of a first panel.

FIG. 1A shows a schematic layout of the electrode group, and FIG. 1B shows a schematic partial cross-sectional view of the first panel 10 taken along arrows B—B in FIG. 1A. For clarifying the electrodes in FIG. 1A, the electrodes are provided with slanting lines. In FIG. 1A, showing of the dielectric layer 14 and the protective layer 15 is omitted, and in FIG. 1B, showing of the protective layer 15 is omitted.

Each electrode group comprises (A) a first sustain electrode 12A having two sides (two edges) $\mathbf{12A_1}$ and $\mathbf{12A_2}$ opposed to each other and extending in the form of a stripe, (B) a second sustain electrode 12B having two sides (two edges) $\mathbf{12B_1}$ and $\mathbf{12B_2}$ opposed to each other and extending in the form of a stripe, (C) a first bus electrode 13A that is in contact with a nearly straight one side (one edge) $\mathbf{12A_1}$ of the first sustain electrode 12A, and (D) a second bus electrode 13B that is in contact with a nearly straight one side (one edge) $\mathbf{12B_1}$ of the second sustain electrode 12B and is extending in parallel with the first bus electrode 13A.

The other side (other edge) $\mathbf{12A_2}$ of the first sustain electrode 12A in the form of a stripe and the other side (other edge) $\mathbf{12B_2}$ of the second sustain electrode 12B in the form of a stripe have a curved form (specifically, the form of a combination of an arc and an elliptical curve) each. Further, the other side (other edge) $\mathbf{12A_2}$ of the first sustain electrode 12A in the form of a stripe and the other side (other edge) $\mathbf{12B_2}$ of the second sustain electrode 12B in the form of a stripe face each other, and the distance (t) between the other side (other edge) $\mathbf{12A_2}$ of the first sustain electrode 12A in the form of a stripe and the other side (other edge) $\mathbf{12B_2}$ of the second sustain electrode 12B in the form of a stripe is greater in a region where they are together close to the bus electrode 13A or 13B than in other region. Specifically, the maximum value ($t_{max}$) of the distance in the regions where the other side (other edge) $\mathbf{12A_2}$ of the first sustain electrode 12A and the other side (other edge) $\mathbf{12B_2}$ of the second sustain electrode 12B were together closest to the bus electrodes 13A and 13B was set to be 100 $\mu$m, and the minimum value ($t_{min}$) of the distance in other region was set to be 25 $\mu$m.

The first and second sustain electrodes 12A and 12B are made of ITO (indium-tin oxide), and the first and second bus electrodes 13A and 13B are made of a Cr/Al/Cr stacked film.

Figure 2:
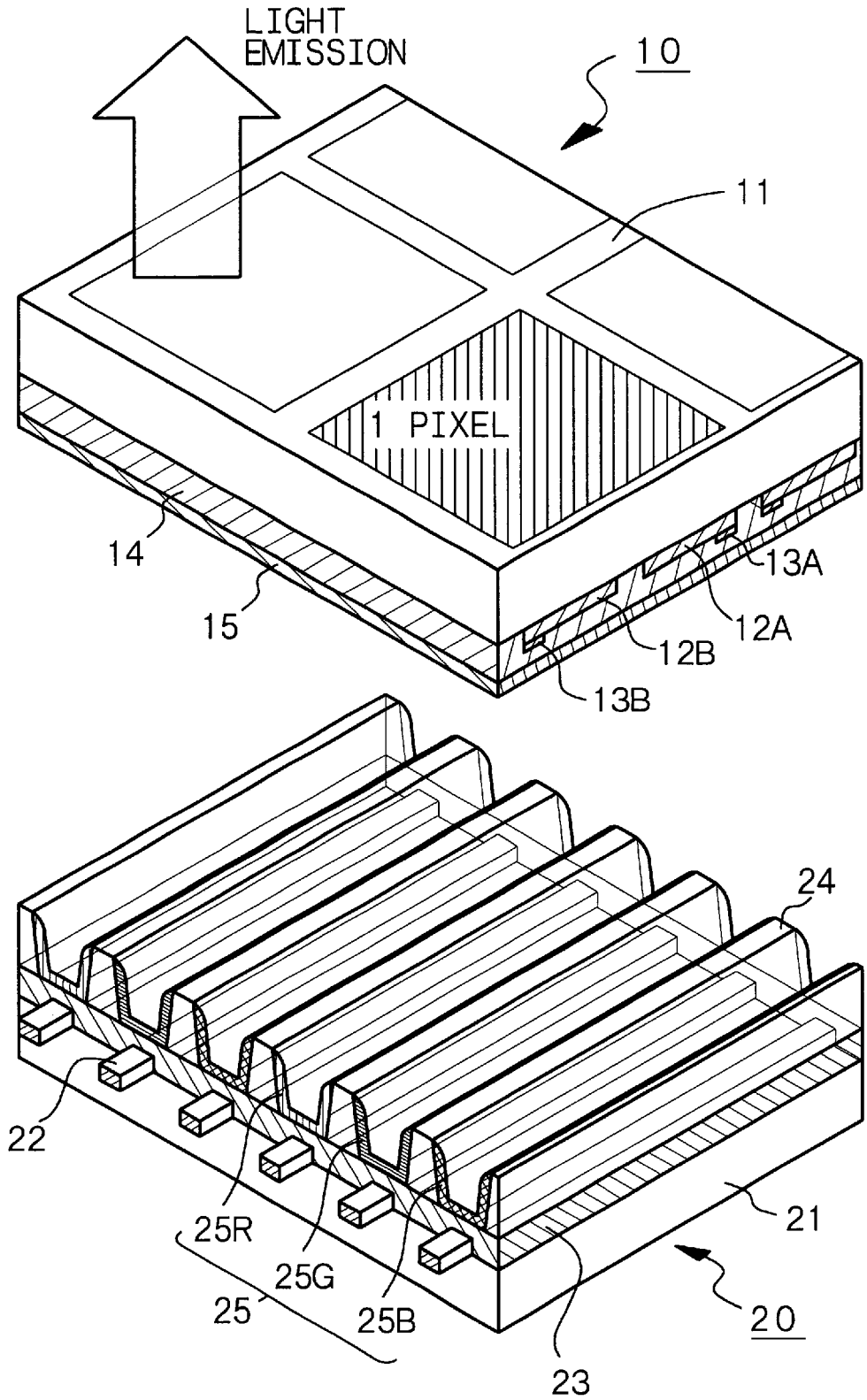
FIG. 2 is a schematic exploded perspective view of the alternating current driven type plasma display of Example 1.

The second panel 20 comprises a second substrate 21, a plurality of second electrodes (also called address electrodes 22 or data electrodes) formed in the form of stripes on the second substrate 21, a dielectric material layer 23 formed on the second substrate 21 and also on the address electrodes 22, insulating separation walls 24 extending in regions on the dielectric material layer 23 between adjacent address electrodes 22 and extending in parallel with the address electrodes 22, and phosphor layers 25 formed on the dielectric material layer 23 and also on the side walls of the separation walls 24. When the plasma display is for display in colors, each phosphor layer 25 is composed of a red phosphor layer 25R, a green phosphor layer 25G and a blue phosphor layer 25B, and these phosphor layers 25R, 25G and 25B are provided in a predetermined order. FIG. 2 is a partial exploded perspective view, and in an actual embodiment, top portions of the separation walls 24 on the second panel side are in contact with the protective layer 15 on the first panel side. A region where a pair of the sustain electrodes 12A and 12B and the address electrode 22 positioned between two separation walls 24 overlap corresponding to one discharge cell. Each discharge space surrounded by adjacent separation walls 24, the phosphor layer 25 and the protective layer 15 is charged with a discharge gas. The first panel 10 and the second panel 20 are bonded to each other in their circumferential portions with a frit glass.

The extending direction of projection image of the bus electrodes 13A and 13B and the extending direction of projection image of the address electrodes 22 cross each other at right angles, and a region where a pair of the sustain electrodes 12A and 12B and one set of the phosphor layers 25R, 25G and 25B for emitting light in three primary colors overlap corresponds to one pixel. In the discharge cell, the phosphor layer excited by irradiation with vacuum ultraviolet ray generated in the discharge gas on the basis of glow discharge emits light in a color characteristic of the kind of a phosphor material. Vacuum ultraviolet ray having a wavelength based on the kind of the charged discharge gas is generated. Light emission of the phosphor layer 25 on the second panel is viewed, for example, through the first panel 10.

The discharge gas charged in the discharge space is composed, for example, of a mixture prepared by mixing approximately 4% by volume of xenon (Xe) gas with an neon (Ne) gas, and the gas mixture had a total pressure of approximately $6\times10^4$ Pa.

The method of producing the tri-electrode type plasma display having a structure shown in FIGS. 1A, 1B and 2 will be explained below.

The first panel 10 was fabricated by the following method. First, an ITO layer was formed on the first substrate 11 made of a high-distortion-point glass or a soda glass, for example, by a sputtering method, and the ITO layer was patterned in the form of stripes by photolithography and an etching technique, to form pairs of the sustain electrodes 12A and 12B. Then, a Cr/Al/Cr stacked layer was formed on the entire surface, for example, by a vapor deposition method, and the Cr/Al/Cr stacked layer was patterned by photolithography and an etching technique, to form the bus electrodes 13A and 13B each of which was along one side $\mathbf{12A_1}$ or $\mathbf{12B_1}$ of the sustain electrode 12A or 12B.

Then, the dielectric layer 14 that was made of a low-melting glass (glass paste) and had a thickness of 20 $\mu$m was formed on the entire surface by a screen printing method. Then, the protective layer 15 that had a thickness of 0.6 $\mu$m and was made of magnesium oxide (MgO) was formed on the dielectric layer 14 by an electron beam vapor deposition method. The first panel 10 was completed by the above steps.

The second panel 20 was fabricated by the following method. First, a silver paste was printed in the form of stripes on the second substrate 21 made of a high-distortion-point glass or a soda glass, for example, by a screen printing method, and calcined or sintered to form address electrodes 22. The address electrodes 22 were extending in the direction at right angles with the extending direction of the bus electrodes 13A and 13B. Then, a low-melting glass paste layer was formed on the entire surface by a screen printing method, and the low-melting glass paste layer was calcined or sintered to form the dielectric material layer 23. Then, a low-melting glass paste was printed on the dielectric material layer 23 above regions between adjacent address electrodes 22, for example, by a screen printing method, and calcined or sintered to form the separation walls 24. The separation walls 24 had an average height of 130 $\mu$m. Then, phosphor slurries for three primary colors were consecutively printed and calcined or sintered to form the phosphor layers 25R, 25G and 25B on the dielectric material layer 23 between separation walls 24 and also on the side walls of the separation walls 24. The second panel 20 was completed by the above steps.

Then, the plasma display was assembled. That is, first, a frit glass layer was formed on a circumferential portion of the second panel, for example, by a screen printing method, and then the first panel 10 and the second panel 20 were bonded to each other, followed by calcining or sintering to cure the frit glass layer. Then, a space formed between the first panel 10 and the second panel 20 was vacuumed and then charged with Ne—Xe mixed gases, and such space was sealed to complete the plasma display.

In the plasma display of Example 1, the distance between the other side (other edge) 12A2 of the first sustain electrode 12A in the form of a stripe and the other side (other edge) $12B_2$ of the second sustain electrode 12B in the form of a stripe was greater in a region where they were together close to the bus electrode 13A or 13B than in other region. This constitution reliably prevented the occurrence of abnormal discharge between the first sustain electrode 12A and the second bus electrode 13B and the occurrence of abnormal discharge between the second sustain electrode 12B and the first bus electrode 13A.

Figure 3:
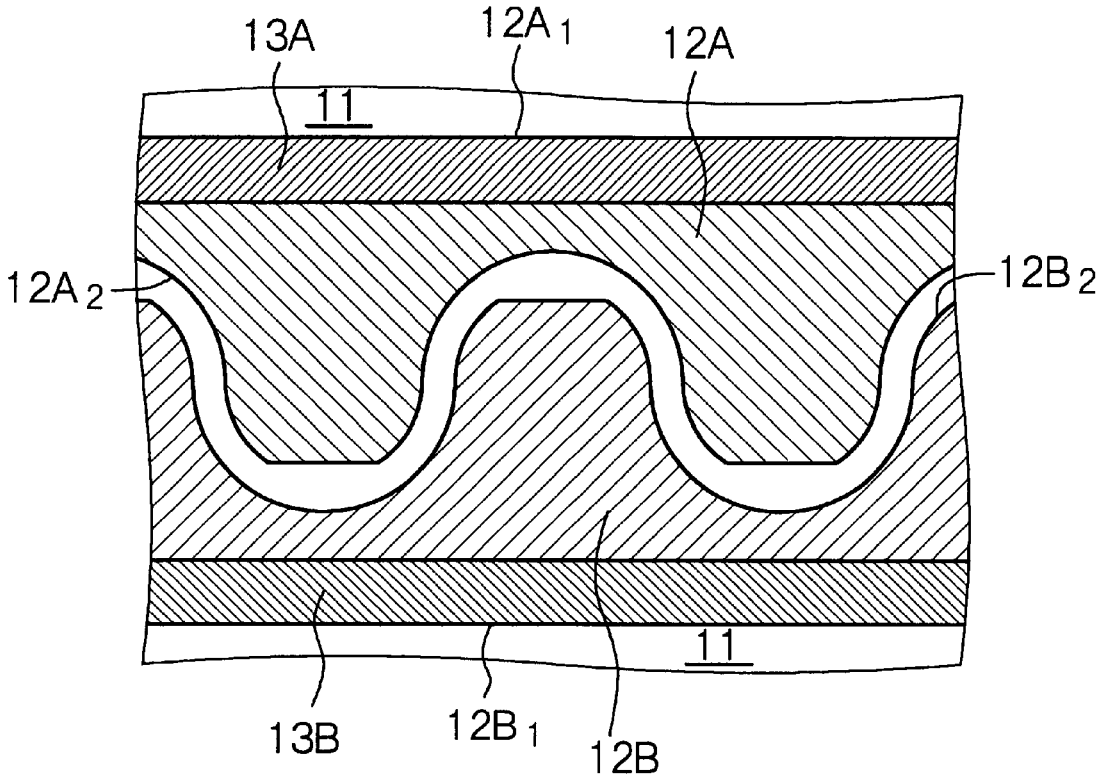
FIG. 3 is a schematic layout of a variant of the electrode group in the alternating current driven type plasma display of Example 1.

FIG. 3 shows a variant of the plasma display of Example 1. In the variant, the other side $12A_2$ of the first sustain electrode 12A and the other side $12B_2$ of the second sustain electrode 12B have the form of a combination of an arc and a line segment each. The line segment is arranged in a position where other side $12A_2$ of the first sustain electrode 12A or the other side $12B_2$ of the second sustain electrode 12B is close to the bus electrodes 13A or 13B, in parallel with the bus electrodes 13A and 13B.

EXAMPLE 2

Figure 4A:
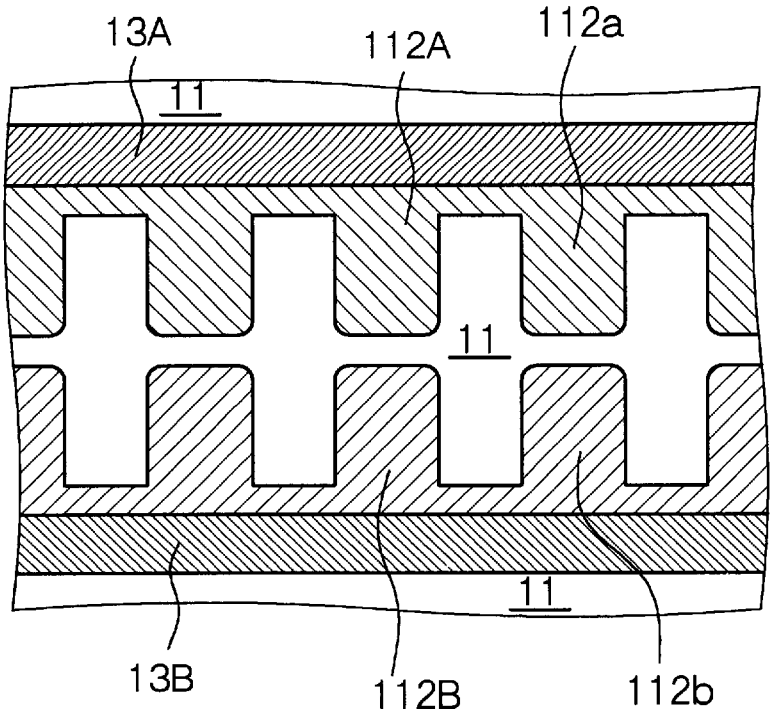
FIGS. 4A and 4B are schematic layouts of the electrode group in an alternating current driven type plasma display of Example 2.
Figure 4B:
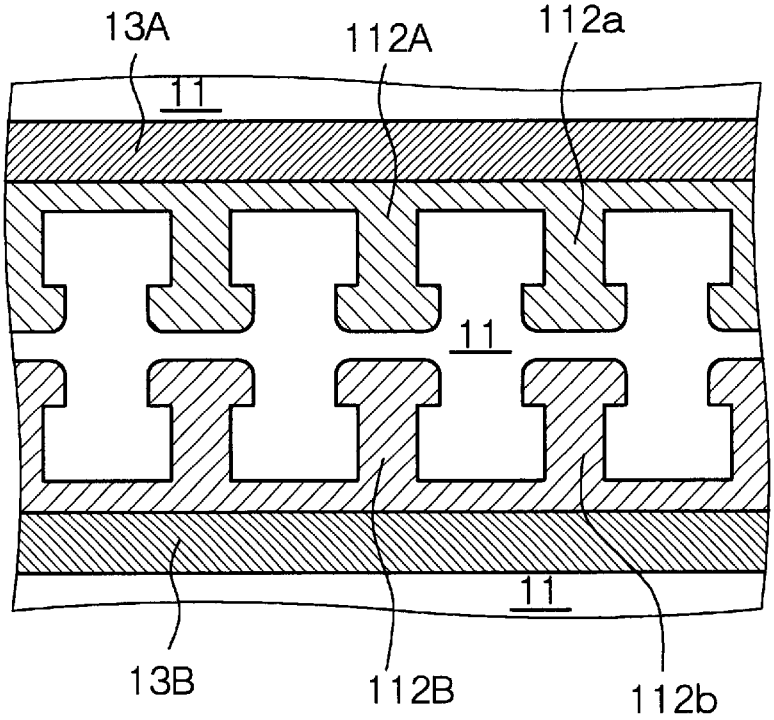

Example 2 is concerned with the plasma display according to the second aspect of the present invention. Since the basis structure of the plasma display of Example 2 is the same as that of the plasma display of Example 1, a detailed explanation thereof is omitted. Each of FIGS. 4A and 4B shows a schematic layout of the electrode group of the plasma display of Example 2. In FIGS. 4A and 4B, the electrodes are provided with slanting lines for clearly showing them. The dielectric layer 14 and the protective layer 15 are omitted from showing in these Figures.

Each electrode group of the plasma display of Example 2 comprises (A) a first bus electrode 13A, (B) a second bus electrode 13B extending in parallel with the first bus electrode 13A, (C) a first sustain electrode 112A having a projection portion 112*a* extending from the first bus electrode 13A toward the second bus electrode 13B, and (D) a second sustain electrode 112B having a projection portion 112*b* extending from the second bus electrode 13B toward the projection portion 112*a* of the first sustain electrode 112A.

The top end portion of the projection portion 112*a* of the first sustain electrode 112A and the top end portion of the projection portion 112*b* of the second sustain electrode 112B face each other, and the corner portions of the top end portion of the projection portion 112*a* of the first sustain electrode 112A and the corner portions of the top end portion of the projection portion 112*b* of the second sustain electrode 112B are chamfered. Specifically, the corner portions have a roundish form. The distance between the top end portion of the projection portion 112*a* of the first sustain electrode 112A and top end portion of the projection portion 112*b* of the second sustain electrode 112B (the distance between the top end portions excluding the corner portions) was set to be 25 $\mu$m.

The projection portions 112*a* and 112*b* shown in FIG. 4A have a nearly rectangular form as a plane form each, and the projection portions 112*a* and 112*b* shown in FIG. 4B have a nearly T-letter form as a plane form each.

In the plasma display of Example 2, the corner portions of the top end portion of the projection portion 112*a* of the first sustain electrode 112A and the corner portions of the top end portion of the projection portion 112*b* of the second sustain electrode 112B were chamfered, so that a kind of projections were removed from the top end portions of the projection portions 112*a* and 112*b*. As a result, the occurrence of abnormal discharge between the projection portion 112*a* of the first sustain electrode 112A and the projection portion 112*b* of the second sustain electrode 112B was reliably prevented.

Since the plasma display of Example 2 can be produced in the same manner as in the production of the plasma display of Example 1 except that the first sustain electrode 112A and the second sustain electrode 112B differ in patterned form, a detailed explanation of the production method thereof is omitted.

EXAMPLE 3

Example 3 is concerned with the plasma display according to the third aspect of the present invention. Since the basis structure of the plasma display of Example 3 is also the same as that of the plasma display of Example 1, a detailed explanation thereof is omitted.

Figure 5A:
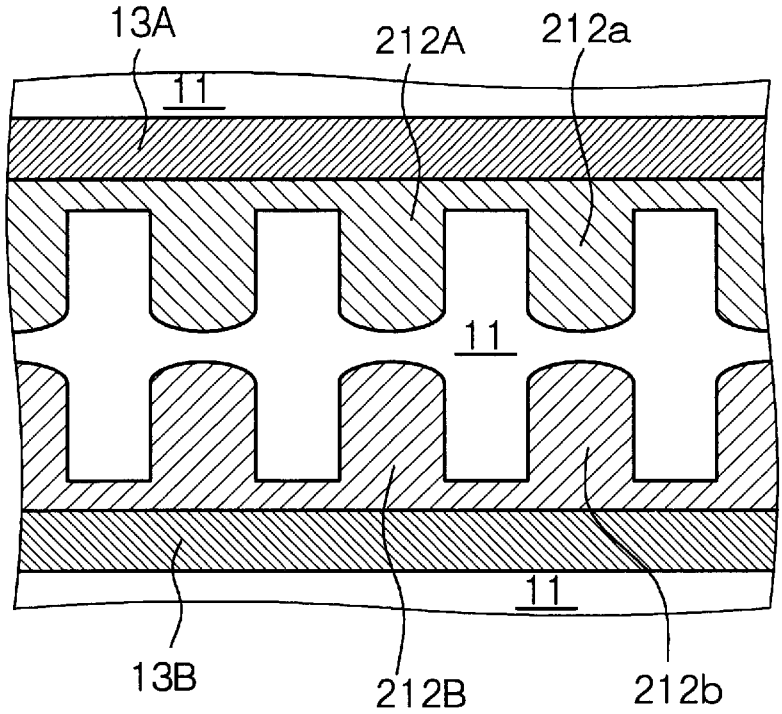
FIGS. 5A and 5B are schematic layouts of the electrode group in an alternating current driven type plasma display of Example 3.
Figure 5B:
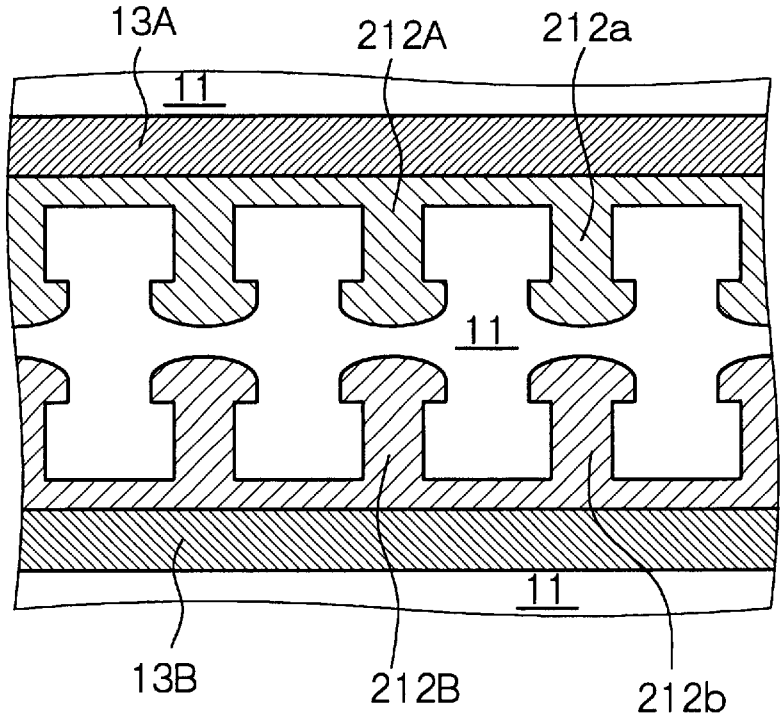
Figure 6:
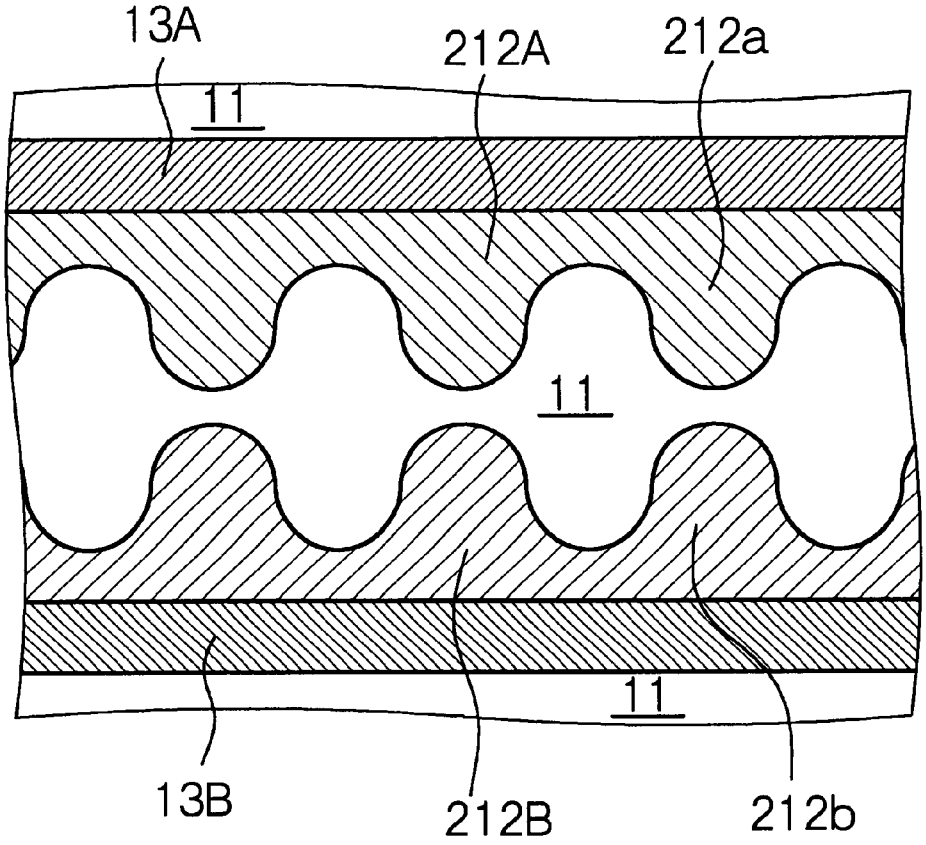
FIG. 6 is a schematic layout of the electrode group in an alternating current driven type plasma display of Example 3.

Each of FIGS. 5A, 5B and 6 shows a schematic layout of the electrode group of the plasma display of Example 3. In FIGS. 5A, 5B and 6, the electrodes are provided with slanting lines for clearly showing them. The dielectric layer 14 and the protective layer 15 are omitted from showing in these Figures.

Each of the electrode groups of the plasma display of Example 3 comprises (A) a first bus electrode 13A, (B) a second bus electrode 13B extending in parallel with the first bus electrode 13A, (C) a first sustain electrode 212A having a projection portion 212*a* extending from the first bus electrode 13A toward the second bus electrode 13B, and (D) a second sustain electrode 212B having a projection portion 212*b* extending from the second bus electrode 13B toward the projection portion 212*a* of the first sustain electrode 212A.

The top end portion of the projection portion 212*a* of the first sustain electrode 212A and the top end portion of the projection portion 212*b* of the second sustain electrode 212B face each other, and the distance between the top end portion of the projection portion 212*a* of the first sustain electrode 212A and the top end portion of the projection portion 212*b* of the second sustain electrode 212B is broadened from the center of each top end portion to the edge portions of each top end portion. The shortest distance between the top end portion of the projection portion 212*a* of the first sustain electrode 212A and the top end portion of the projection portion 212*b* of the second sustain electrode 212B was set to be 25 $\mu$m.

The projection portions 112*a* and 112*b* shown in FIG. 5A have a nearly rectangular form as a plane form each, and the projection portions 112*a* and 112*b* shown in FIG. 5B have a nearly T-letter form as a plane form each. The top end portion of each of projection portion 212*a* and 212*b* of the sustain electrodes 212A and 212B has the form of a moderately curved line, specifically, an elliptical curve. Further, each of projection portions 212*a* and 212*b* shown in FIG. 6 has a nearly semi-circular form.

In the plasma display of Example 3, the distance between the top end portion of the projection portion 212*a* of the first sustain electrode 212A and the top end portion of the projection portion 212*b* of the second sustain electrode 212B was broadened from the center of each top end portion to the edge portions of each top end portion, whereby the occurrence of abnormal discharge between the projection portion 112*a* of the first sustain electrode 112A and the projection portion 112*b* of the second sustain electrode 112B was reliably prevented.

Since the plasma display of Example 3 can be produced in the same manner as in the production of the plasma display of Example 1 except that the first sustain electrode 112A and the second sustain electrode 112B differ in patterned form, a detailed explanation of the production method thereof is omitted.

EXAMPLE 4

Example 4 is concerned with the plasma display according to the fourth aspect of the present invention. Since the basis structure of the plasma display of Example 4 is also the same as that of the plasma display of Example 1, a detailed explanation thereof is omitted.

Figure 7A:
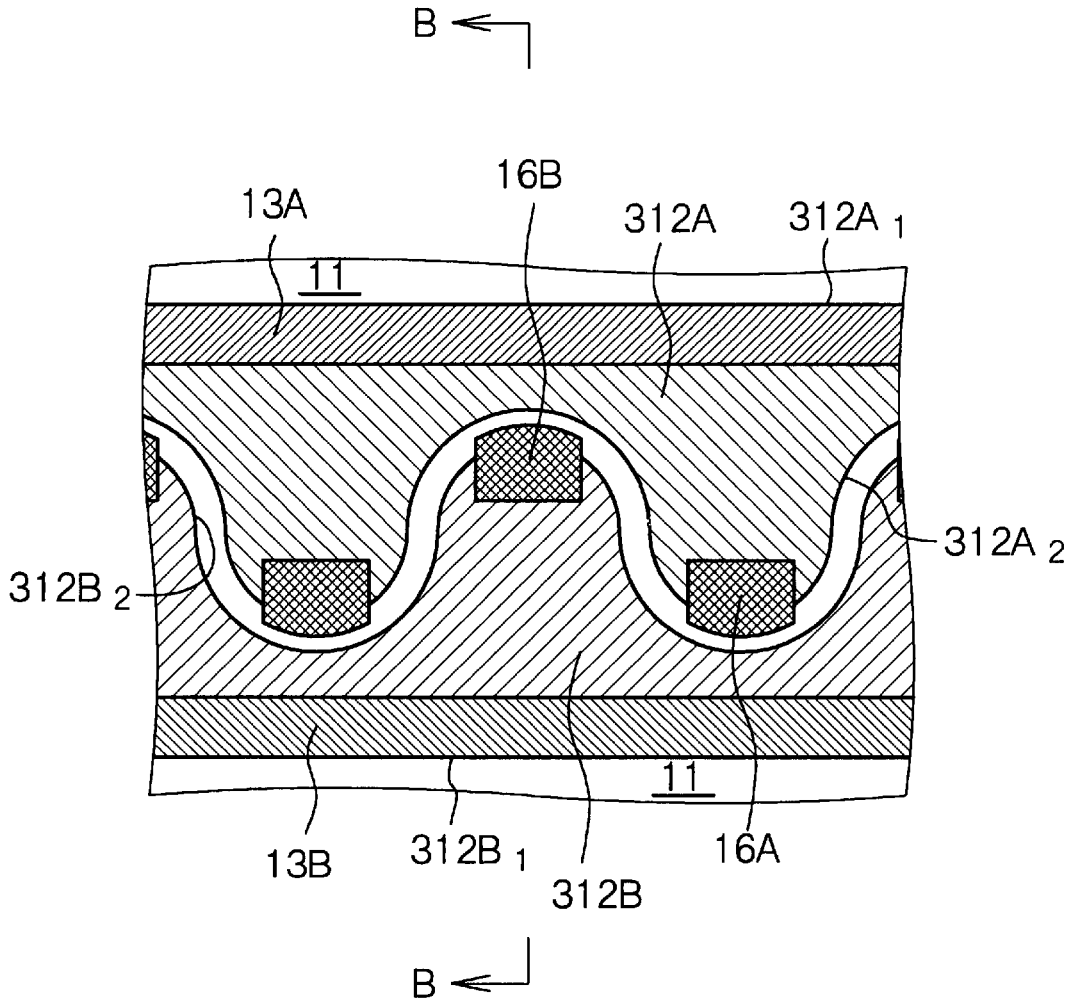
FIG. 7A is a schematic layout of the electrode group in an alternating current driven type plasma display of Example 4.
Figure 7B:
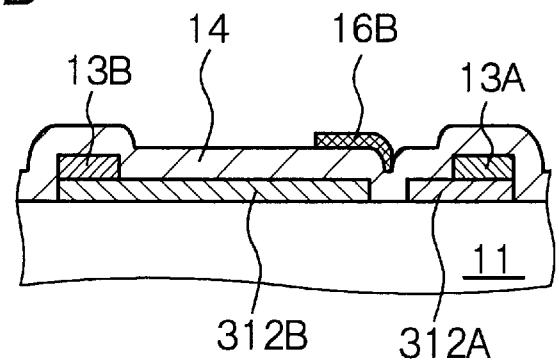
FIG. 7B is a schematic partial cross-sectional view of a first panel.

FIG. 7A shows a schematic layout of the electrode group of the plasma display of Example 4, and FIG. 7B shows a schematic partial cross-sectional view of the first panel 10 taken along arrows B—B in FIG. 7A. In FIG. 7A, the electrodes are provided with slanting lines for clearly showing them. The dielectric layer 14 and the protective layer 15 are omitted from showing in FIG. 7A, and the protective layer 15 is omitted from showing in FIG. 7B.

Each of the electrode groups of the plasma display of Example 4 comprises (A) a first sustain electrode 312A having two sides (two edges) 312$A_1$ and 312$A_2$ opposed to each other and extending in the form of a stripe, (B) a second sustain electrode 312B having two sides (two edges) 312$B_1$ and 312$B_2$ opposed to each other and extending in the form of a stripe, (C) a first bus electrode 13A that is in contact with one nearly-straight side (one edge) 312A1 of the first sustain electrode 312A, and (D) a second bus electrode 13B that is in contact with one nearly-straight side (one edge) 312B1 of the second sustain electrode 312B and extending in parallel with the first bus electrode 13A.

The other side (other edge) 312$A_2$ of the first sustain electrode 312A in the form of a stripe and the other side (other edge) 312$B_2$ of the second sustain electrode 312B in the form of a stripe face each other, and the other side 312$A_2$ of the first sustain electrode 312A in the form of a stripe and the other side 312$B_2$ of the second sustain electrode 312B in the form of a stripe have the form of an arc.

In Example 4, the distance between the other side 312$A_2$ of the first sustain electrode 312A and the other side 312$B_2$ of the second sustain electrode 312B was set to be constant (25 $\mu$m).

A first discharge-inhibiting layer 16A is formed in a portion of the other side 312$A_2$ of the first sustain electrode 312A in a region where the first sustain electrode 312A is close to the second bus electrode 13B, and a second discharge-inhibiting layer 16B is formed in a portion of the other side 312$B_2$ of the second sustain electrode 312B in a region where the second sustain electrode 312B is close to the first bus electrode 13A. In Example 4, the discharge-inhibiting layers 16A and 16B were made of $SiO_2$ and had a thickness of 5 $\mu$m. The discharge-inhibiting layers 16A and 16B may be made, for example, of a glass sintered body or a stack of $SiO_2$ and a glass sintered body, and this will be also applied to explanations to be given hereinafter.

In the plasma display of Example 4, the discharge-inhibiting layers 16A and 16B were formed, whereby the occurrence of abnormal discharge between the first sustain electrode 312A and the second bus electrode 13B or abnormal discharge between the second sustain electrode 312B and the first bus electrode 13A was reliably prevented.

The plasma display of Example 4 can be produced in the same manner as in the production of the plasma display of Example 1 except that, after the protective layer 15 is formed, the discharge-inhibiting layers 16A and 16B are formed by forming a layer made of $SiO_2$ on the entire surface, for example, by a sputtering method and patterning the thus-formed layer by lithography and an etching technique, so that a detailed explanation of the production method thereof is omitted.

Figure 8A:
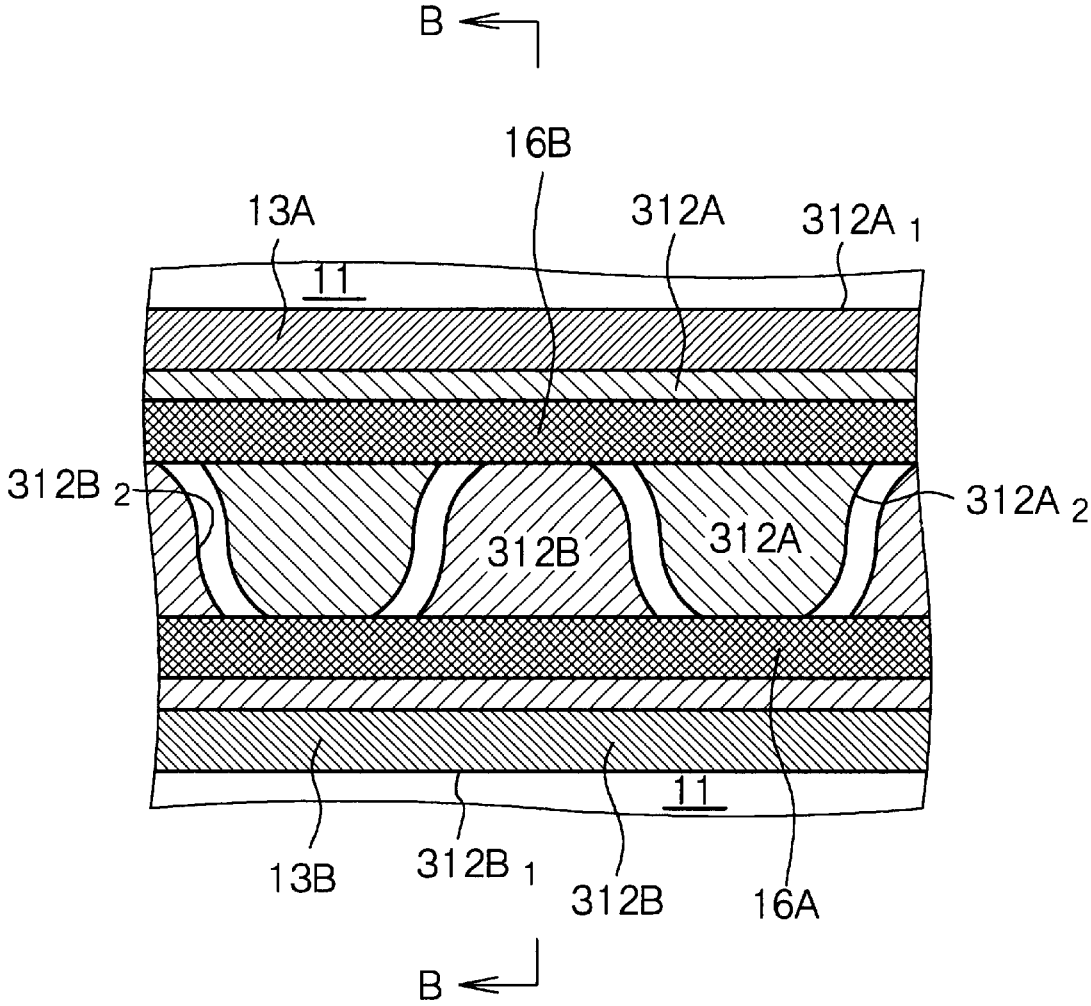
FIG. 8A is a schematic layout of a variant of the electrode group in the alternating current driven type plasma display of Example 4.
Figure 8B:
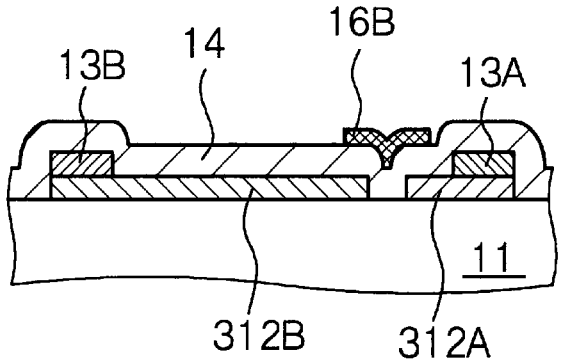
FIG. 8B is a schematic partial cross-sectional view of a first panel.

FIGS. 8A and 8B show a variant of the plasma display of Example 4. FIG. 8A shows a schematic layout of the electrode group of such a variant plasma display, and FIG. 8B shows a schematic partial cross-sectional view of the first panel 10 taken along arrows B—B in FIG. 8A. In FIG. 8A, the electrodes are provided with slanting lines for clearly showing them. The dielectric layer 14 and the protective layer 15 are omitted from showing in FIG. 8A, and the protective layer 15 is omitted from showing in FIG. 8B.

In this variant, a first discharge-inhibiting layers 16A is formed, in the form of a stripe, from a portion of the other side 312$A_2$ of the first sustain electrode 312A to a portion of the other side 312$B_2$ of the second sustain electrode 312B in a region where the first sustain electrode 312A is close to the second bus electrode 13B. A second discharge-inhibiting layer 16B is formed from a portion of the other side 312$A_2$ of the first sustain electrode 312A to a portion of the other side 312$B_2$ of the second sustain electrode 312B in a region where the second sustain electrode 312B is close to the first bus electrode 13A.

The discharge-inhibiting layers explained in Example 4 can be also applied to the plasma display having the electrode constitution explained in Example 1.

EXAMPLE 5

Figure 9A:
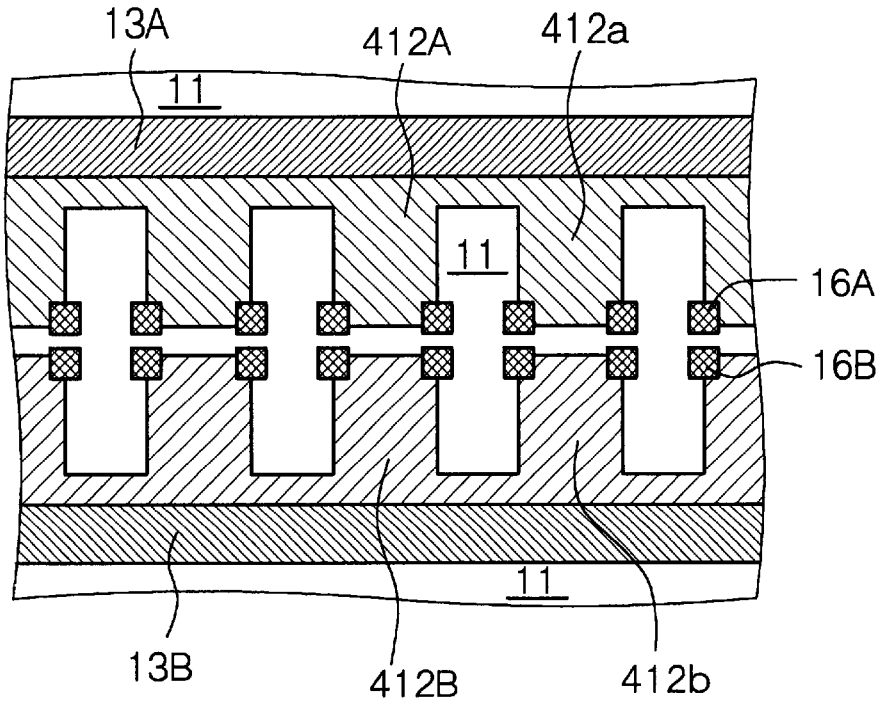
FIGS. 9A and 9B are schematic layouts of the electrode group in an alternating current driven type plasma display of Example 5.
Figure 9B:
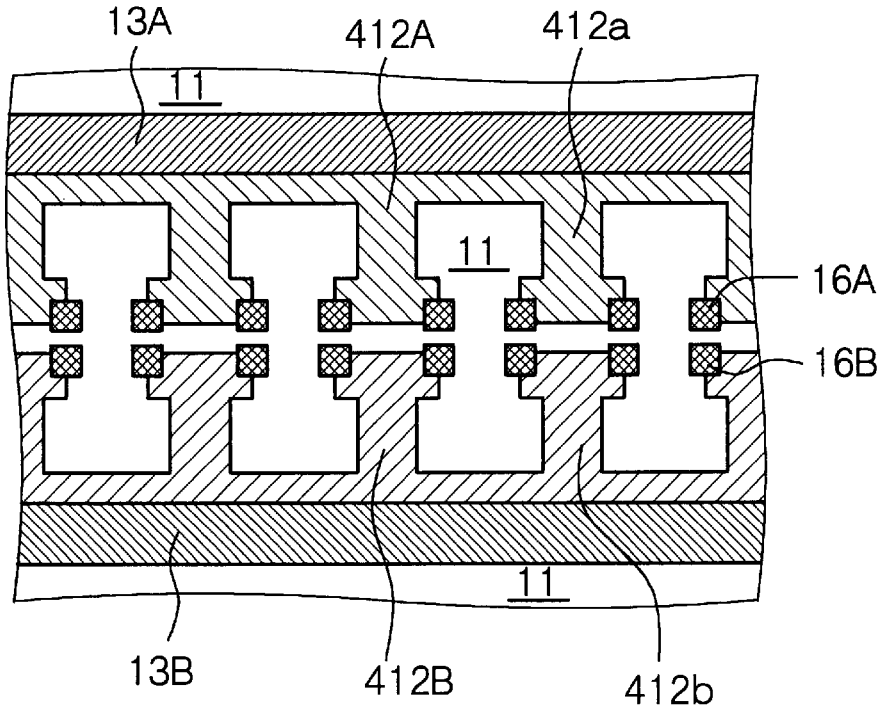

Example 5 is concerned with the plasma display according to the fifth aspect of the present invention. Since the basis structure of the plasma display of Example 5 is also the same as that of the plasma display of Example 1, a detailed explanation thereof is omitted. Each of FIGS. 9A and 9B shows a schematic layout of the electrode group of the plasma display of Example 5. In FIGS. 9A and 9B, the electrodes are provided with slanting lines for clearly showing them. Further, the dielectric layer 14 and the protective layer 15 are omitted from showing in these Figures.

Each of the electrode groups of the plasma display of Example 5 comprises (A) a first bus electrode 13A, (B) a second bus electrode 13B extending in parallel with the first bus electrode 13A, (C) a first sustain electrode 412A having a projection portion 412*a* extending from the first bus electrode 13A toward the second bus electrode 13B, and (D) a second sustain electrode 412B having a projection portion 412*b* extending from the second bus electrode 13B toward the projection portion 412*a* of the first sustain electrode 412A.

The top end portion of the projection portion 412*a* of the first sustain electrode 412A and the top end portion of the projection portion 412*b* of the second sustain electrode 412B face each other. Discharge-inhibiting layers (first discharge-inhibiting layers 16A and second discharge-inhibiting layers 16B) are formed on the corner portions of the top end portion of the projection portion 412*a* of the first sustain electrode 412A and on the corner portions of the top end portion of the projection portion 412*b* of the second sustain electrode 412B. In Example 5, the discharge-inhibiting layers 16A and 16B were made of $SiO_2$ and had a thickness of 5 $\mu$m. The distance between the top end portion of the projection portion 412*a* of the first sustain electrode 412A and the top end portion of the projection portion 412*b* of the second sustain electrode 412B was set to be 25 $\mu$m.

The projection portions 412*a* and 412*b* shown in FIG. 9A have a nearly rectangular form as a plane form each, and the projection portions 412*a* and 412*b* shown in FIG. 9B have a nearly T-letter form as a plane form each.

In the plasma display of Example 5, the discharge-inhibiting layers 16A and 16B were formed, whereby the occurrence of abnormal discharge between the projection portion 412*a* of the first sustain electrode 412A and the projection portion 412B of the second sustain electrode 412B, particularly between the corner portions, was reliably prevented.

The plasma display of Example 5 can be produced in the same manner as in the production of the plasma display of Example 1 except that, after the protective layer 15 is formed, the discharge-inhibiting layers 16A and 16B are formed by forming a layer made of $SiO_2$ on the entire surface, for example, by a sputtering method and patterning the thus-formed layer by lithography and an etching technique, so that a detailed explanation of the production method thereof is omitted.

The discharge-inhibiting layers explained in Example 5 can be applied to the electrode constitutions of the plasma displays explained in Example 2 and 3.

While the present invention has been explained with reference to Examples hereinabove, the present invention shall not be limited thereto. Those structures and constitutions of the plasma display, materials, dimensions and production methods are all given for explanation purposes and can be changed or altered as required.

Figure 10A:
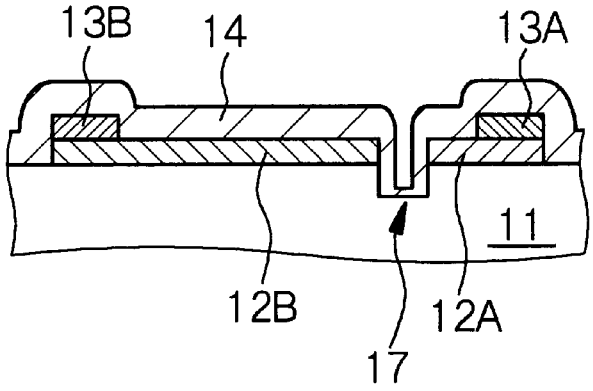
FIGS. 10A, 10B and 10C are schematic partial cross-sectional views of a first substrate, etc., for showing variants of the alternating current driven type plasma display of the present invention.
Figure 10B:
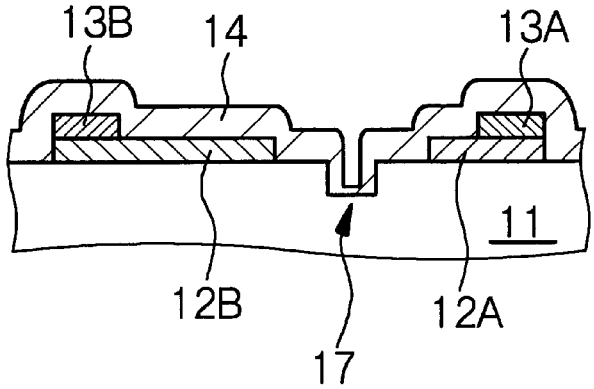
Figure 10C:
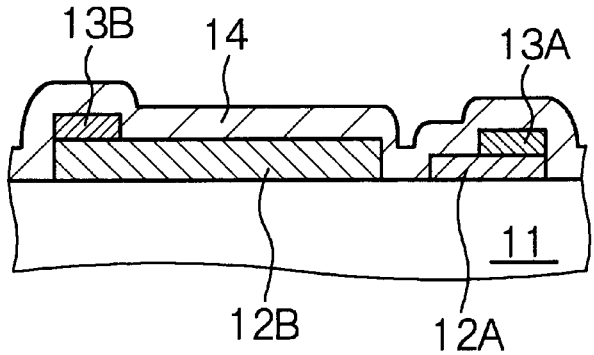
Figure 11:
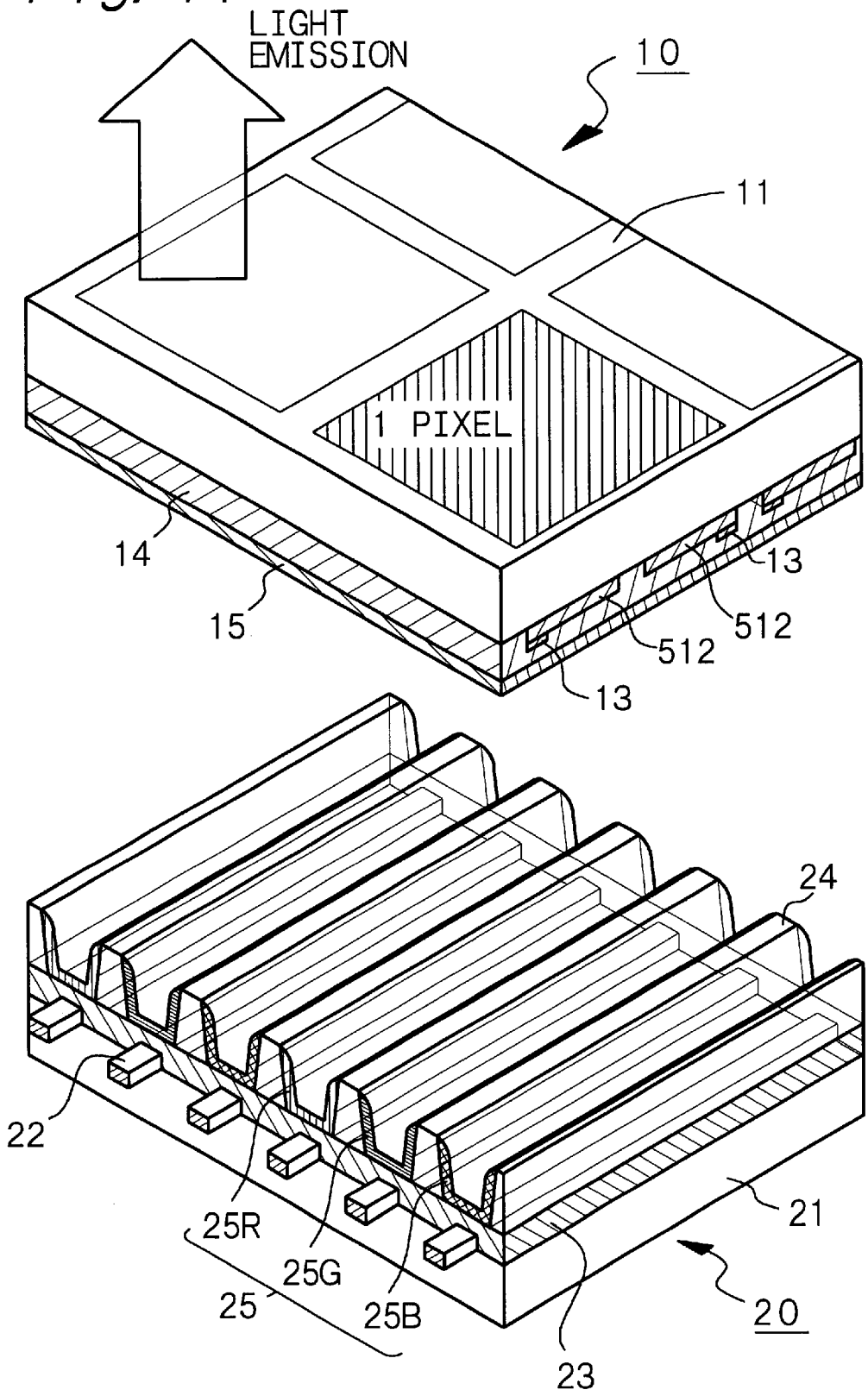
FIG. 11 is a schematic exploded perspective view of a conventional alternating current driven type plasma display.
Figure 12A:
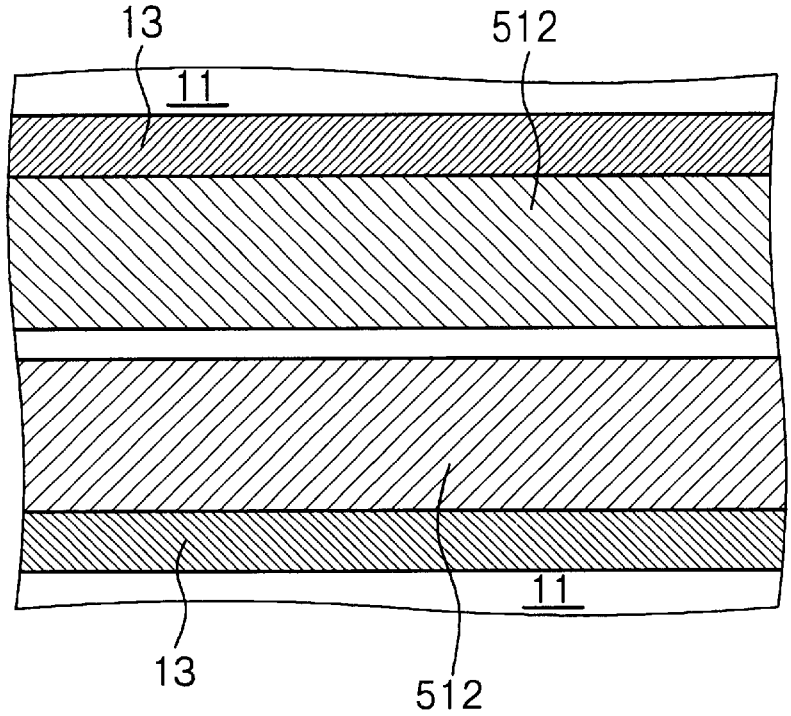
FIGS. 12A and 12B are schematic drawings showing plane forms of a pair of conventional sustain electrodes.
Figure 12B:
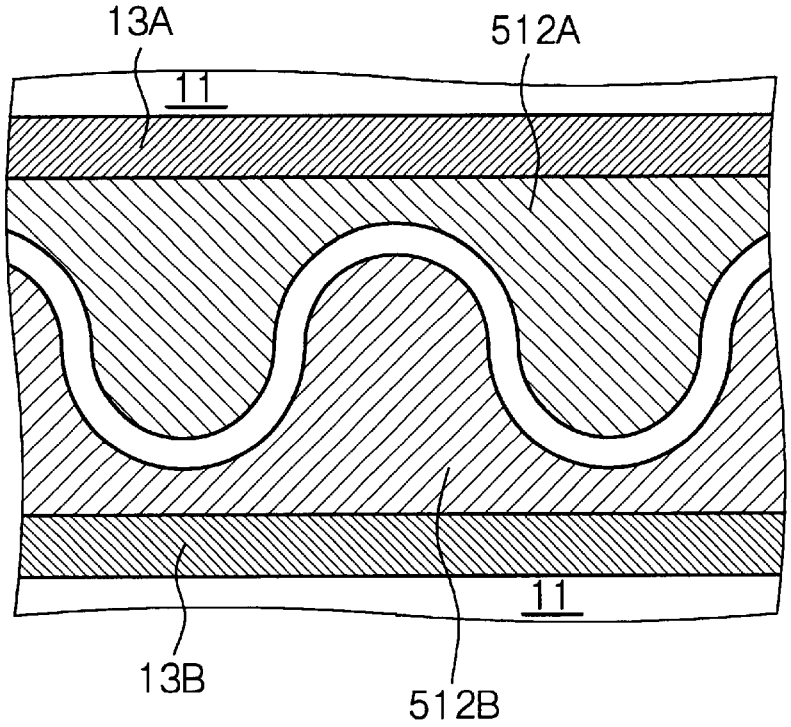
Figure 13A:
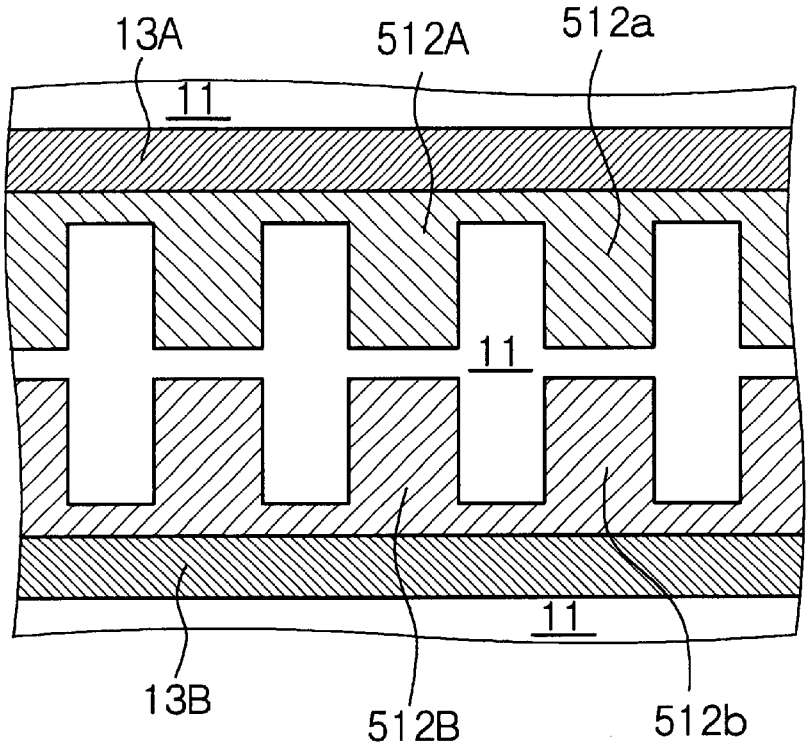
FIGS. 13A and 13B are schematic drawings showing plane forms of a pair of conventional sustain electrodes.
Figure 13B:
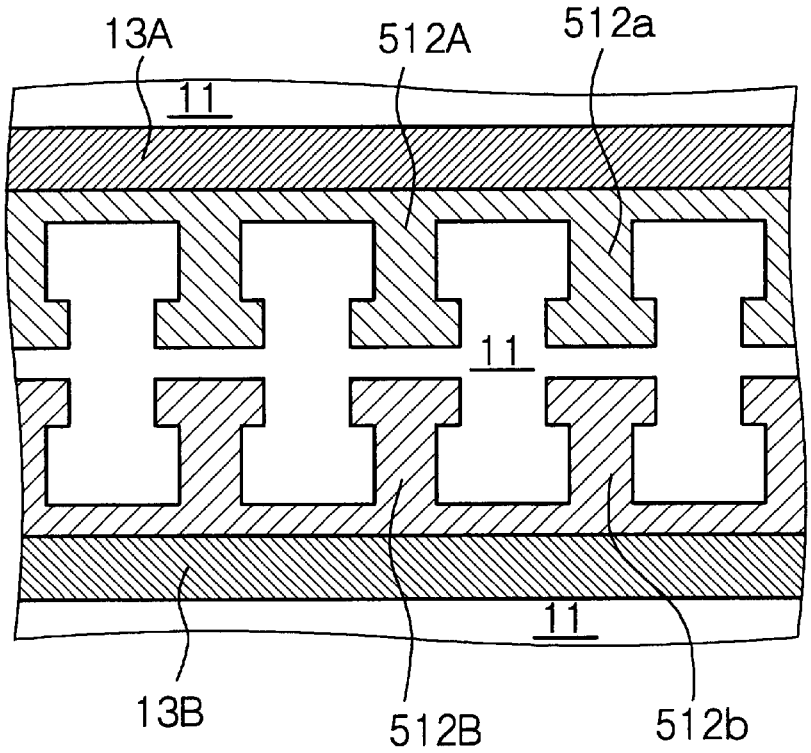

In the plasma display of each Example, a trench may be formed in the first substrate 11 between the sustain electrodes that face each other, for increase the discharge space. FIG. 10A shows a schematic partial cross-sectional view of the first substrate 11, etc., in which a trench 17 is formed in the plasma display of Example 1. FIG. 10B shows a schematic partial cross-sectional view of the first substrate 11, etc., in which a trench 17 is formed in the first substrate 11 when the distance between the other side of the first sustain electrode in the form of a stripe and the other side of the second sustain electrode in the form of a stripe is large. In the plasma display of each Example, the thickness of the first sustain electrode and the thickness of the second sustain electrode may be different from each other. FIG. 10C shows a schematic partial cross-sectional view of the first substrate 11, etc., in which the first and second sustain electrodes 12A and 12B differ in thickness in the plasma display of Example 1. In FIGS. 10A, 10B and 10C, the protective layer 15 is omitted from showing.

The address electrodes may be formed in the first substrate. A plasma display having such a structure can be composed of, for example, a pair of sustain electrodes and a pair of bus electrodes extending in a first direction and the address electrode provided along one sustain electrode and in the vicinity of one sustain electrode (provided that the address electrode along one sustain electrode has a length equal to, or smaller than, the length of the discharge cell in the first direction). For preventing the formation of a short-circuit to the sustain electrode, there is employed a structure in which a wiring for the address electrode which wiring extends in a second direction is formed through an insulating layer and the wiring for the address electrode is electrically connected to the address electrode, or the address electrode is extending from the wiring for the address electrode.

One example of AC glow discharge operation of the plasma display of the present invention will be explained below. First, for example, a pulse voltage higher than a discharge start voltage $V_{bd}$ is applied to all of the sustain electrodes for a short period of time (each of such sustain electrodes corresponding to one of the sustain electrodes forming each pair), whereby glow discharge takes place, and due to dielectric polarization, a wall charge is generated on the surface of the dielectric layer 14 near such sustain electrodes and is accumulated, so that an apparent discharge start voltage decreases. Then, while a voltage is applied to the address electrodes 22, a voltage is applied to such sustain electrodes included in the discharge cells which are not driven for display, whereby glow discharge is allowed to take place between the address electrodes 22 and such sustain electrodes to erase the accumulated wall charge. The above discharge for erasing is carried out consecutively in the address electrodes 22. On the other hand, no voltage is applied to such sustain electrodes included in the discharge cells which are driven for display, whereby the accumulation of the wall charge is sustained. Then, a predetermined pulse voltage is applied between all the pairs of the sustain electrodes. As a result, in the discharge cells having the wall charge accumulated, glow discharge starts between the sustain electrodes forming each pair, and in such discharge cells, the phosphor layers excited by irradiation with vacuum ultraviolet ray generated on the basis of the glow discharge in the discharge gas in the discharge spaces emit light in colors characteristic of phosphor materials. The phase of the discharge sustain voltage applied to one of a pair of the sustain electrodes and the phase of the discharge sustain voltage applied to the other of a pair of sustain electrodes deviate by half a cycle, and the polarity of the sustain electrodes is reversed depending upon the frequency of alternating current.

Alternatively, the AC glow discharge of the plasma display of the present invention can be operated as follows. First, erasing discharge is carried out on all of pixels for initializing all the pixels, and then discharge operation is carried out. The discharge operation is divided into an address period for which a wall charge is generated on the surface of the dielectric layer by initial discharge and a discharge sustain period for which the discharge is sustained. In the address period, a pulse voltage lower than the discharge start voltage $V_{bd}$ is applied to the selected sustain electrodes and the selected address electrodes for a short period of time (each of such sustain electrodes corresponding to one of the sustain electrodes forming each pair). A Region where such pulse-applied sustain electrode and the pulse-applied address electrode overlap is selected as a display pixel, and in the overlap region, the wall charge is generated on the surface of the dielectric layer due to dielectric polarization, and is accumulated. In the succeeding discharge sustain period, a discharge sustain voltage $V_{sus}$ lower than $V_{bd}$ is applied to a pair of the sustain electrodes. When the sum of the wall voltage $V_w$ induced by the wall charge and the discharge sustain voltage $V_{sus}$ comes to be greater than the discharge start voltage $V_{bd}$, (i.e., when $V_w+V_{sus}>V_{bd}$), glow discharge starts. The phases of the sustain voltages $V_{sus}$ applied to one of a pair of the sustain electrodes and the phase of the sustain voltages $V_{sus}$ applied to the other of a pair of the sustain electrodes deviate from each other by half a cycle, and the polarity of each sustain electrode is reversed according to the frequency of alternating current.

In the plasma display of the present invention, the distance between the sustain electrodes forming a pair or the form of pairs of the sustain electrodes has a characteristic feature, or the discharge-inhibiting layers are formed, so that the occurrence of abnormal discharge can be effectively prevented. As a result, the destruction of the electrode structure can be prevented, the plasma display is free from deterioration of the display quality, a decrease in reliability and a decrease in lifetime, and there can be prevented a phenomenon that the durability for breakdown of components of the plasma display is degraded by abnormal discharge. Further, deteriorations of and detrimental effects on the image quality such as an abnormal bright point and a dropout can be inhibited, and high-quality pictures can be displayed.

Further, the consumption of a temporary excess current caused by large current that takes place due to abnormal discharge is inhibited, and as a result, it can be expected that the power consumption can be decreased in image display operation, a load on an operation circuit is decreased, and the operation circuit is improved in reliability. Further, a load on the durability for breakdown of and current resistance of parts constituting the operation circuit can be decreased, and a protective circuit having redundancy is no longer necessary or is decreased or minimized, so that the production cost for the plasma display can be decreased. Further, the occurrence of abnormal discharge that can be induced between the sustain electrode and the address electrode by the occurrence of abnormal discharge can be prevented, so that the deterioration of the address electrodes, the phosphor layers and the dielectric material layer can be prevented. When the discharge-inhibiting layers are formed, further, the deterioration of the dielectric layer and the protective layer can be also prevented.

What is claimed is:

1. An alternating current driven type plasma display comprising a first panel having electrode groups formed on a first substrate and a dielectric layer formed on the first substrate and on the electrode groups, and a second panel, the first and second panels being bonded to each other in their circumferential portions, wherein each electrode group comprises;

A) a first sustain electrode having two sides opposed to each other and extending in the form of a stripe, B) a second sustain electrode having two sides opposed to each other and extending in the form of a stripe, C) a first bus electrode that is in contact with one nearly-straight side of the first sustain electrode, and D) a second bus electrode that is in contact with one nearly-straight side of the second sustain electrode and extending in parallel with the first bus electrode, and further wherein the other side of the first sustain electrode in the form of a stripe and the other side of the second sustain electrode in the form of a stripe face each other, at least part of the other side of the first sustain electrode in the form of a stripe and at least part of the other side of the second sustain electrode in the form of a stripe have the form of a curved line each, a first discharge-inhibiting layer is formed at least in a portion of the other side of the first sustain electrode in a region where the first sustain electrode is close to the second bus electrode, and a second discharge-inhibiting layer is formed at least in a portion of the other side of the second sustain electrode in a region where the second sustain electrode is close to the first bus electrode.

2. An alternating current driven type plasma display comprising a first panel having electrode groups formed on a first substrate and a dielectric layer formed on the first substrate and on the electrode groups, and a second panel, the first and second panels being bonded to each other in their circumferential portions, wherein each electrode group comprises;

(A) a first bus electrode, (B) a second bus electrode extending in parallel with the first bus electrode, (C) a first sustain electrode having a projection portion extending from the first bus electrode toward the second bus electrode, and (D) a second sustain electrode having a projection portion extending from the second bus electrode toward the projection portion of the first sustain electrode, and further wherein the top end portion of the projection portion of the first sustain electrode and the top end portion of the projection portion of the second sustain electrode face each other, and a discharge-inhibiting layer is formed on each corner portion of the top end portion of the projection portion of the first sustain electrode and on each corner portion of the top end portion of the projection portion of the second sustain electrode.

* * * * *